US012680729B1

(12) United States Patent
Chadbourne et al.

(10) Patent No.: US 12,680,729 B1
(45) Date of Patent: Jul. 14, 2026

(54) FURNACE WITH IMPROVED EFFICIENCY CONTROLS

(71) Applicant: Trane International Inc., Davidson, NC (US)

(72) Inventors: Andrew Chadbourne, Winona, TX (US); Alexis Urquia Gutierrez, Davidson, NC (US); Gordon Jeffrey Hugghins, Jacksonville, TX (US)

(73) Assignee: Trane International Inc., Davidson, NC (US)

( * ) Notice: Subject to any disclaimer, the term of this patent is extended or adjusted under 35 U.S.C. 154(b) by 257 days.

(21) Appl. No.: 18/392,512

(22) Filed: Dec. 21, 2023

(51) Int. Cl.
*F24H 8/00* (2022.01)
*F24H 3/08* (2022.01)
*F24H 15/156* (2022.01)

(52) U.S. Cl.
CPC ..... *F24H 15/156* (2022.01); *F24H 3/087* (2013.01); *F24H 8/00* (2013.01)

(58) Field of Classification Search
CPC ..... F24H 15/156; F24H 3/087; F24H 8/00
See application file for complete search history.

(56) References Cited

U.S. PATENT DOCUMENTS 4,703,747 A 11/1987 Thompson et al.
4,729,207 A 3/1988 Dempsey et al.
4,842,510 A 6/1989 Grunden et al.
4,872,828 A 10/1989 Mierzwinski et al.
4,955,806 A 9/1990 Grunden et al.
5,248,083 A 9/1993 Adams et al.
5,418,438 A 5/1995 Hollenbeck
5,616,995 A 4/1997 Hollenbeck
5,676,069 A 10/1997 Hollenbeck
5,682,826 A 11/1997 Hollenbeck
6,257,870 B1 7/2001 Hugghins et al.
6,283,115 B1 9/2001 Dempsey et al.
6,321,744 B1 11/2001 Dempsey et al.
6,377,426 B2 4/2002 Hugghins et al.
6,535,838 B2 3/2003 Abraham et al.
7,241,135 B2 7/2007 Munsterhuis et al.
7,985,066 B2 7/2011 Chian et al.
8,070,481 B2 12/2011 Chian et al.
8,123,518 B2 2/2012 Nordberg et al.
8,146,584 B2 4/2012 Thompson
8,672,670 B2 3/2014 Hugghins
(Continued)

*Primary Examiner* — Nael N Babaa
(74) *Attorney, Agent, or Firm* — Womble Bond Dickinson (US) LLP

(57) ABSTRACT

Example implementations of the present disclosure relate to systems and methods for improving the efficiency of a furnace. This process may include initiating combustion of the fuel in the burner assembly at an intermediate firing rate; operating the furnace in warm-up stage following initiating the combustion of the fuel, the warm-up stage including operating the burner assembly at the intermediate firing rate and not operating the circulation blower; operating the furnace in a boost stage following the warm-up stage, the boost stage including operating the burner assembly at the intermediate firing rate and initiating operation of the circulation blower; and operating the furnace in a low-capacity setting following the boost stage, the low-capacity setting including operating the burner assembly at a low-capacity firing rate, the low-capacity firing rate being a lower firing rate than the intermediate firing rate.

20 Claims, 9 Drawing Sheets

(56) References Cited

U.S. PATENT DOCUMENTS

| | | | | |
|---|---|---|---|---|
| 8,683,993 | B2 | 4/2014 | Paller et al. | |
| 8,689,635 | B2 | 4/2014 | Shih | |
| 8,764,435 | B2 | 7/2014 | Nordberg et al. | |
| 8,965,725 | B2 | 2/2015 | Ferran et al. | |
| 9,200,847 | B2 | 12/2015 | Thompson | |
| 9,285,802 | B2 | 3/2016 | Arensmeier | |
| 9,291,355 | B2 | 3/2016 | Hugghins | |
| 9,618,231 | B2 | 4/2017 | Kowald et al. | |
| 9,731,387 | B2 | 8/2017 | Kumar | |
| 9,741,023 | B2 | 8/2017 | Arensmeier et al. | |
| 9,784,449 | B2 | 10/2017 | Margolin | |
| 9,964,304 | B2 | 5/2018 | Noman | |
| 10,094,591 | B2 | 10/2018 | Garloch et al. | |
| 10,174,969 | B2 | 1/2019 | Kowald et al. | |
| 10,253,981 | B2 | 4/2019 | Kowald et al. | |
| 10,254,008 | B2 | 4/2019 | Thompson | |
| 10,344,975 | B2 | 7/2019 | Noman | |
| 10,648,664 | B2 | 5/2020 | Reed et al. | |
| 10,753,623 | B2 | 8/2020 | Harris | |
| 10,935,238 | B2 | 3/2021 | Anwar | |
| 11,221,266 | B2 | 1/2022 | Mackenzie et al. | |
| 11,340,569 | B2 | 5/2022 | Young et al. | |
| 11,549,708 | B2 | 1/2023 | Broker et al. | |
| 2008/0127963 | A1 | 6/2008 | Thompson | |
| 2013/0230812 | A1 | 9/2013 | Schultz et al. | |
| 2016/0209054 | A1* | 7/2016 | Nordberg | F24H 15/35 |
| 2021/0222914 | A1 | 7/2021 | King | |
| 2022/0276626 | A1 | 9/2022 | Young et al. | |
| 2023/0143249 | A1 | 5/2023 | Gitzinger et al. | |
| 2023/0204295 | A1 | 6/2023 | Zhang et al. | |
| 2023/0235922 | A1* | 7/2023 | Boyd | F24H 3/025 126/116 A |

* cited by examiner

FURNACE WITH IMPROVED EFFICIENCY CONTROLS

TECHNOLOGICAL FIELD

The present disclosure relates generally to systems and methods for controlling the operation of a modulating furnace to improve efficiency, including at low-load conditions.

BACKGROUND

Various furnaces for climate control systems exist and provide heating for a conditioned space, such as an internal space of a home, office, or retail store. Furnaces may provide heating via a number of different methods. Each of these designs offer various advantages, and typically provide for heating over a given temperature range and load condition. Typical furnaces combust a hydrocarbon fuel source, such as, propane or natural gas, and then transfer the heat from the combustion process to heat air that is circulated through the conditioned space. A common form of these systems flows hot flue products from the combustion process through the interior of a heat exchanger while simultaneously flowing air over the outer surfaces of the heat exchanger to increase the temperature of the air.

During operation, however, these systems go through various processes and conflicting priorities. For example, conditions for ignition are important and may vary from the desired conditions associated with conditioning control. This may be particularly applicable for low-demand situations where the call for heating may require a lower fuel rate then what may be suitable for ignition. Current designs fail to optimize this process, which reduces the overall efficiency of the system.

As a result, there exists a need to improve this process, particularly during the initial stages of furnace operation, to improve the performance of the system. In particular, a system that improves the efficiency of the overall system and allows for better conditioning control for the space serviced by the furnace is desired.

BRIEF SUMMARY

The present disclosure includes, without limitation, the following examples.

Some example implementations include a furnace comprising: a heat exchanger; an inducer fan configured to move air from an air inlet through a combustion flow path; a burner assembly configured to combust a fuel and provide heat to the heat exchanger within the furnace; a circulation blower configured to circulate a conditioned air flow through the furnace and absorb heat from the heat exchanger; and control circuitry operably coupled to the inducer fan, the burner assembly, and the circulation blower, the control circuitry configured to: initiate combustion of the fuel in the burner assembly at an intermediate firing rate, the intermediate firing rate being greater than a minimum firing rate and less than a maximum firing rate; operate the furnace in a warm-up stage for a first period of time following initiating the combustion of the fuel, the warm-up stage including operating the burner assembly at the intermediate firing rate, operating the inducer fan, and maintaining the circulation blower in an off state; operate the furnace in a boost stage for a second period of time following the first period of time, the boost stage including operating the burner assembly at the intermediate firing rate, operating the inducer fan, and operating the circulation blower to flow circulation air through the furnace; and operate the furnace in a low-capacity setting following the second period of time, the low-capacity setting including operating the burner assembly at a low-capacity firing rate, operating the inducer fan, and continuing operation of the circulation blower, the low-capacity firing rate being a lower firing rate than the intermediate firing rate.

Another example implementation includes a method of controlling a furnace to improve efficiency, the furnace including a heat exchanger, an inducer fan, a burner assembly, and a circulation blower, the method comprising: initiating combustion of a fuel in the burner assembly at an intermediate firing rate, the intermediate firing rate being greater than a minimum firing rate and less than a maximum firing rate; operating the furnace in a warm-up stage for a first period of time following initiating the combustion of the fuel, the warm-up stage including operating the burner assembly at the intermediate firing rate, operating the inducer fan, and maintaining the circulation blower in an off state; operating the furnace in a boost stage for a second period of time following the first period of time, the boost stage including operating the burner assembly at the intermediate firing rate, operating the inducer fan, and initiating operation of the circulation blower; and operating the furnace in a low-capacity setting following the second period of time, the low-capacity setting including operating the burner assembly at a low-capacity firing rate, operating the inducer fan, and operating the circulation blower to flow circulation air through the furnace, the low-capacity firing rate being a lower firing rate than the intermediate firing rate.

These and other features, aspects, and advantages of the disclosure will be apparent from a reading of the following detailed description together with the accompanying drawings, which are briefly described below. The disclosure includes any combination of two, three, four, or more of the above-noted embodiments, examples, or implementations as well as combinations of any two, three, four, or more features or elements set forth in this disclosure, regardless of whether such features or elements are expressly combined in a specific example description herein. This disclosure is intended to be read holistically such that any separable features or elements of the disclosed disclosure, in any of its various aspects, embodiments, examples, or implementations, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

Figure 5A:
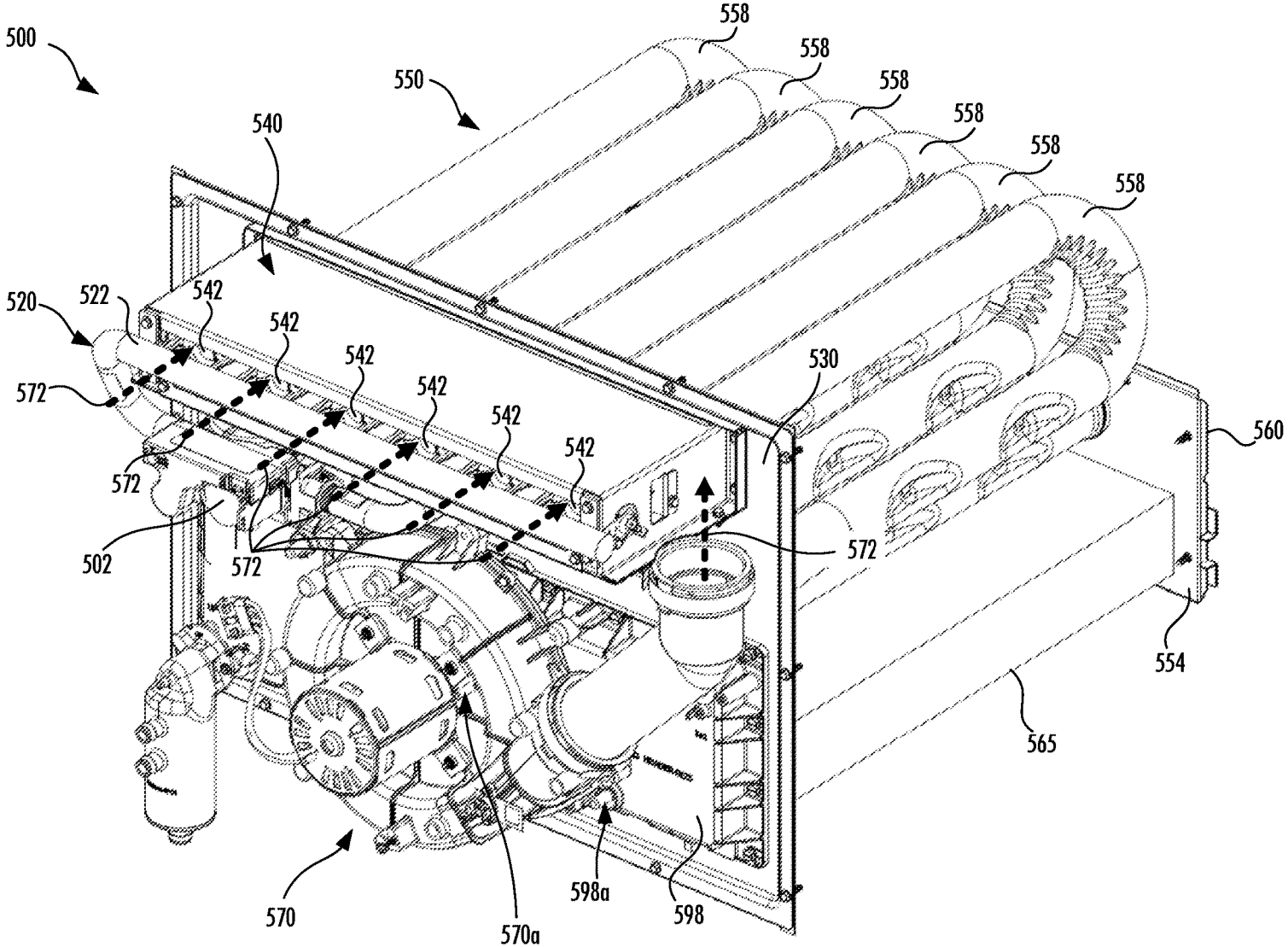
Figure 5B:
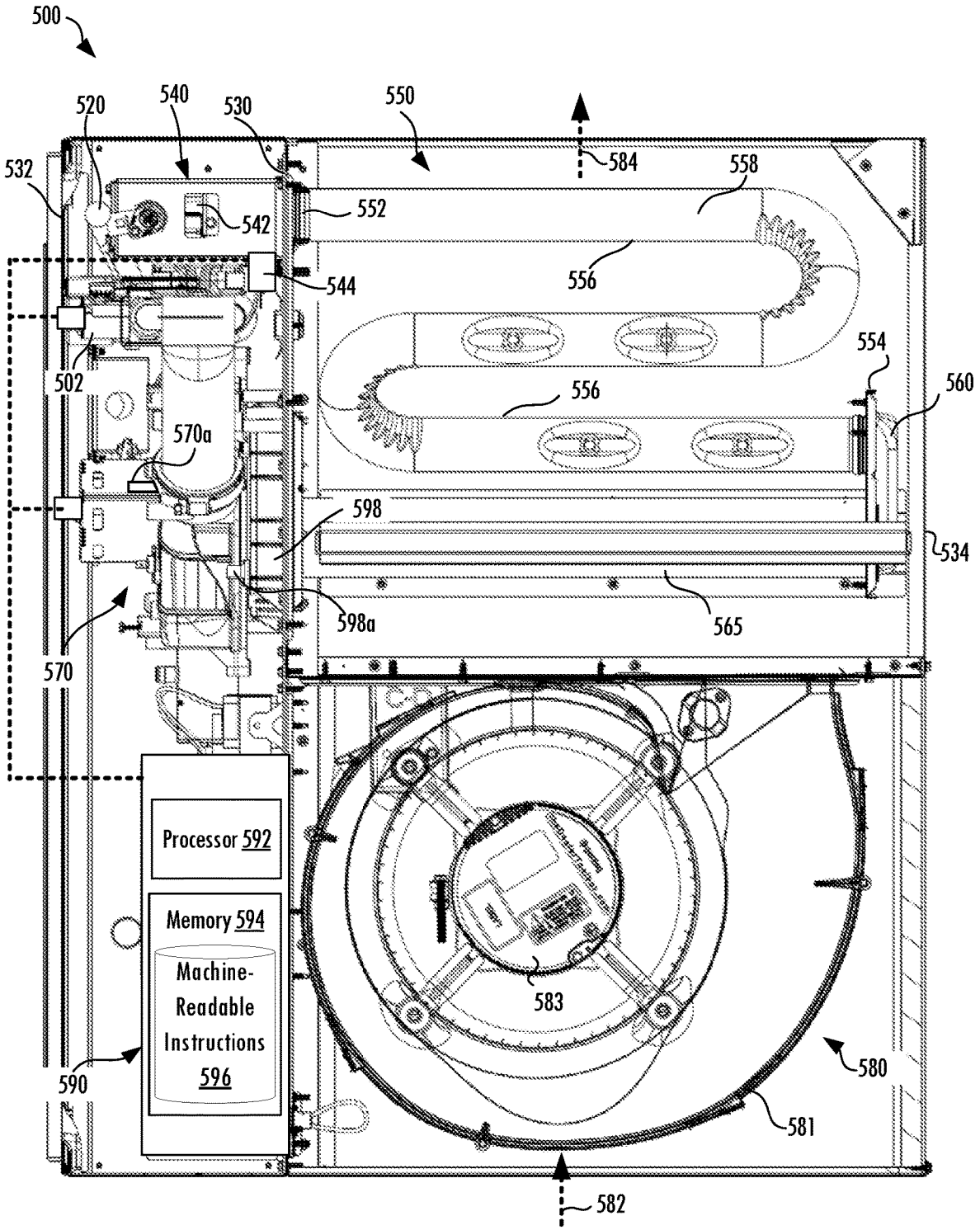
Figure 5C:
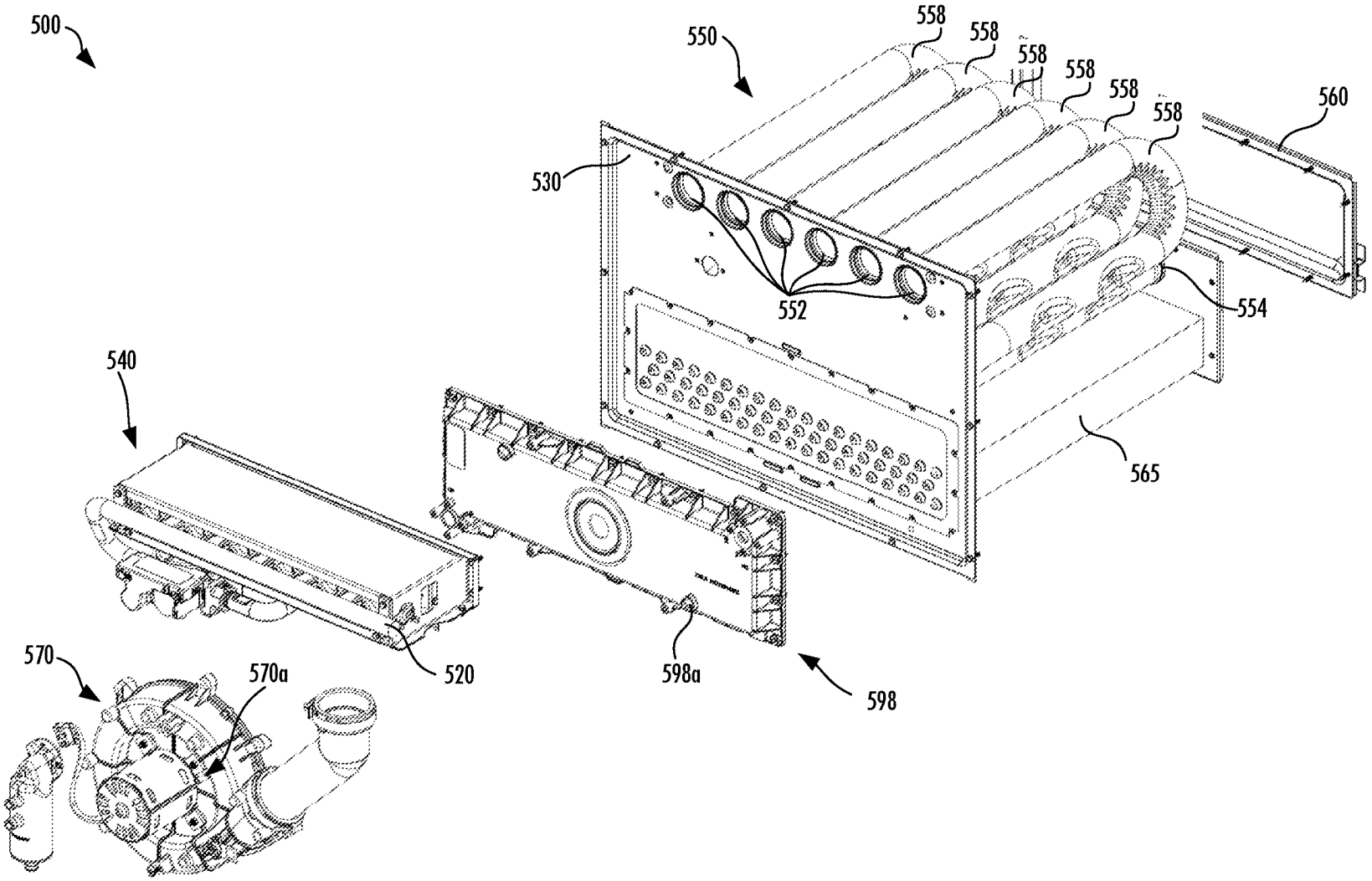
Figure 6:
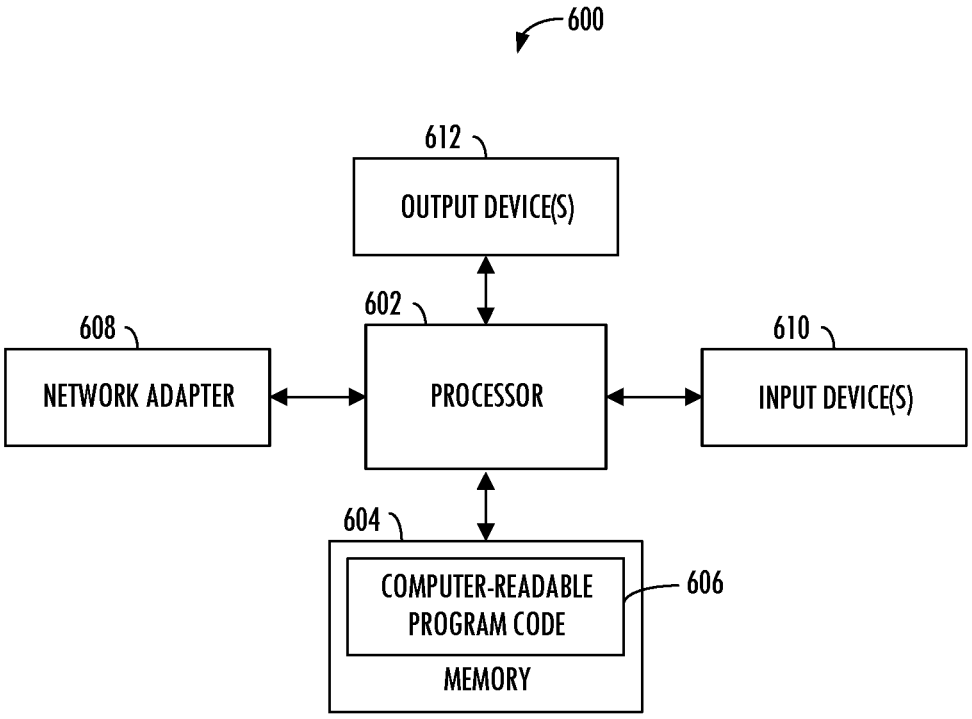

FIGS. 4A, 4B, 4C, 4D, and 4E illustrate flow charts for operating a furnace, according to some example implementations of the present disclosure;

FIG. 5A illustrates a perspective view of a furnace, according to some example implementations of the present disclosure;

FIG. 5B illustrates a side view of a furnace, according to some example implementations of the present disclosure;

FIG. 5C illustrates an exploded view of a furnace, according to some example implementations of the present disclosure; and FIG. 6 illustrates control circuitry, according to some example implementations of the present disclosure.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the embodiments, examples, or implementations set forth herein; rather, these example embodiments, examples, or implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships, or the like, unless otherwise stated, any one or more if not all of these may be absolute or approximate to account for acceptable variations that may occur, such as those due to engineering tolerances or the like.

As used herein, unless specified otherwise, or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments, examples, or implementations of the described disclosure in the installed configuration (e.g., in an operational configuration). It is understood that such terms are not used in any absolute sense.

Example implementations of the present disclosure relate to systems and methods for controlling the ignition and operation of a furnace. These systems and methods include processes for improving the overall efficiency of the furnace, particularly the efficiency per heating cycle, e.g., cyclical efficiency. These improvements are achieved through an advanced startup sequence that allows the furnace, in some instances, to obtain higher temperatures within the heat exchanger during early operation. These higher temperatures may in turn allow for greater heat transfer between combustion process of the furnace and the conditioned air flowing through the furnace.

For example, in the disclosed process, once a call for heating has been received, the furnace may initiate a startup sequence. That sequence may include starting the inducer fan and igniting the fuel source. At this time, the circulation blower may be turned off, or it may be maintained in an off position, and/or it may be adjusted to a setting where the blower is not circulating air flow. The ignition process may have certain requirements. For example, a set firing rate may be used for ignition, and this firing rate may be set to an intermediate level, e.g., a level less than a maximum firing rate and greater than the minimum firing rate. The intermediate level may be advantageous because it helps ensure initial combustion, e.g., ignition, occurs consistently and reliably, without unnecessarily consuming fuel. The inducer fan may be modulated based on the firing rate during the ignition process.

Once ignition has occurred, the furnace may initiate a warmup stage. During the warmup stage, the circulation blower may remain off. In addition, the firing rate for the burner assembly may remain at the same level, potentially the intermediate level. The inducer fan may continue to operate, potentially based on a process that correlates inducer fan speed with firing rate or vice versa. During this warmup stage, the heat exchanger temperature may increase due to the continued operation of the combustion process. This warmup stage may operate for a period of time, potentially expiring after a set period time and/or once a certain temperature is reached within the heat exchanger.

Following the warmup stage, the process may include a boost stage. During the boost stage, the circulating blower may be turned on, potentially to initiate space conditioning. During the boost stage, the firing rate may remain elevated. This may occur even if the request for heating has a lower heating requirement than the heating capacity provided by the set firing rate during the warmup stage. For example, the firing rate may remain at the intermediate level even if the requested demand for heating calls for a firing rate less than the intermediate firing rate, e.g., a minimum firing rate. In these examples, the inducer fan may continue operation.

The boost stage may be helpful to improve the overall efficiency of the system. For example, the boost stage may continue to heat up the heat exchanger within the combustion flow path and/or the conditioning air flow. This boost stage may continue for a set period of time or until a certain condition is reached. For example, if the furnace is a condensing furnace, the boost stage may continue until the condensing process is initiated within the secondary heat exchanger, which would allow for greater total heat exchange between the combustion by-products and the conditioned air. In other examples, the boost stage may continue for a set period of time.

Following the boost stage, the furnace may initiate a capacity operation mode or setting. In this setting, the firing rate may be set based on the requested demand of the space conditioned by the furnace. In addition, in this mode, the inducer blower and the circulating fan may operate according to standard protocols. For example, the inducer fan may continue to be modulated based on the firing rate (or vice versa) to optimize combustion while satisfying the heating demand, and the circulating fan may be operated to maintain a certain discharge temperature, temperature rise, or other condition. In these examples, the capacity operation mode may include a low-capacity setting, where the firing rate is less than the firing rate used to initiate combustion and/or during the boost stage. Still other examples may be utilized.

This disclosed process will be described in greater detail below, and it should be noted that it may be particularly advantageous for lower load operations. This may be because initiating the boost mode increases the heat transfer ratio between the combustion by-products and the circulating air. By establishing that increased heat transfer early in the heating operation for a given cycle, the entire cyclical performance of the furnace may be improved significantly. Now the various components of an example furnace will be described, followed by a more detailed discussion of this optimization process.

Before discussing the details of this process for improving furnace efficiency, an overview of the general structure of example climate control systems including furnaces, and components thereof, will be discussed below with reference to FIG. 1.

Figure 1:
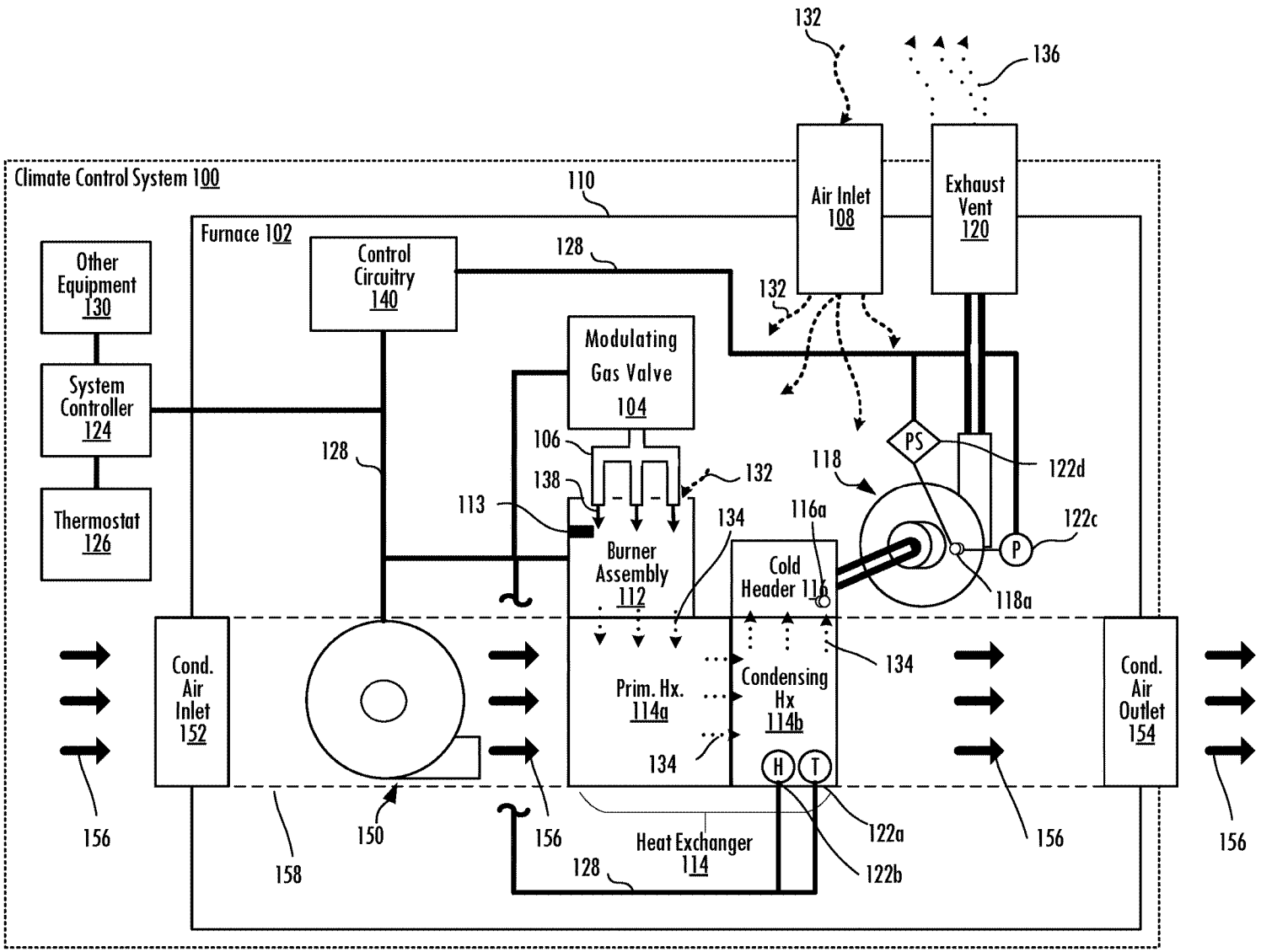
FIG. 1 illustrates a schematic diagram of a climate control system with a furnace, according to some example implementations of the present disclosure.

FIG. 1 illustrates a schematic diagram of an example climate control system 100 configured with a furnace 102 for providing heating capacity to a conditioned space. The climate control system 100 generally comprises furnace 102, a thermostat 126, and a system controller 124 as shown. Additionally, the climate control system 100 may include other equipment 130 as shown. The other equipment 130 may include, at least in part, one or more of an air handler unit including an indoor controller, an outdoor unit including an outdoor controller, an air conditioning unit, or a heat pump for providing cooling capacity, one or more ducts for delivering conditioned air to a conditioned space, vents/registers, and/or other components as described below.

The furnace 102 may be a modulating furnace that generally comprises, as shown, a modulating gas valve 104, a fuel manifold 106, an air inlet 108, a housing 110, a burner assembly 112, a heat exchanger 114 with a cold header 116, an inducer fan 118, an exhaust vent 120, sensors 122, control circuitry 140, and a communication bus 128. The furnace 102 may also include a circulation blower 150 that circulates a circulation air flow 156 through a conditioned air inlet 152 to a conditioned air outlet 154 via a circulation air path 158. In some examples, the furnace 102 may include some or all of the furnace 500 described in further detail below with respect to FIGS. 5A-5C.

The air inlet 108 may be configured to receive airflow 132 for combustion, e.g., from an outdoor ambient environment. In some examples, the air inlet 108 may be configured to extend between the interior of a building, e.g., containing the furnace 102, and the outdoor environment.

The burner assembly 112 may be fluidly coupled to the air inlet 108 via, at least in part, the interior space defined by the housing 110, e.g., a sealed housing, of the furnace 102, as shown, to receive at least airflow 132 from the outdoor environment. The burner assembly 112 may also be fluidly coupled to the fuel source, potentially via the modulating gas valve 104. In some examples, the burner assembly 112 receives the airflow 132 in the form of an air-fuel mixture (not shown). The burner assembly 112 may be configured to burn the air-fuel mixture during a combustion reaction process to reach and maintain a desired firing rate of the furnace 102. As shown, the burner assembly 112 may be further fluidly coupled to the heat exchanger 114, the cold header 116, and the inducer fan 118. Further, the burner assembly 112, the heat exchanger 114, the cold header 116, and the inducer fan 118 may, at least in part, define a combustion flow path 134. The combustion flow path 134 may be, in whole or in part, the flow path that the airflow 132 follows between entering the furnace 102 at the air inlet 108 and exiting the furnace 102 at exhaust vent 120 as flue product 136. In some examples, the combustion flow path 134 may be the same or substantially similar to the combustion flow path 572 as described below with respect to FIGS. 5A-5C.

The burner assembly 112 may be communicatively coupled to the control circuitry 140, e.g., via the communication bus 128, to at least provide firing rate information to the control circuitry 140, e.g., temperature/pressure indications from a temperature/pressure sensor. In some examples, the control circuitry 140 may transmit command signals, e.g., control indications, to the burner assembly 112 or a component thereof, e.g., control an igniter 113 to ignite an air-fuel mixture. In some examples, the burner assembly 112 may include, at least in part, the burner assembly 540 and/or any other components of the furnace 500 to perform the combustion reaction process as described in further detail below with respect to FIGS. 5A-5C.

The modulating gas valve 104 may be fluidly coupled to the burner assembly 112 and configured to modulate the flow of fuel, e.g., from a natural gas line or the like, into the burner assembly 112. In some examples, the modulating gas valve 104 may be communicatively coupled to the control circuitry 140, e.g., via the communication bus 128, to at least provide fuel flowrate information and/or valve positioning information to the control circuitry 140. In some examples, the control circuitry 140 may transmit command signals, e.g., positioning control indications, to the modulating gas valve 104 or a component thereof to open or close the modulating gas valve 104 in order to increase or decrease the fuel flowrate to the burner assembly 112. In some examples, the modulating gas valve 104 may include one or more of a control circuit, a position sensor, a motor, a temperature sensor, a flow meter, or the like. In some examples, the modulating gas valve 104 may monitor fuel flow 138 into the furnace, a temperature of the fuel and/or fuel lines, and/or other operating parameters of the furnace. In the depicted example, the burner assembly 112 includes in-shot burners and is configured to receive airflow 132 and fuel flow 138 separately, e.g., not premixed, at the burner assembly 112. As shown, the airflow 132 is pulled into the burner assembly 112 through gaps between the fuel manifold 106 and the burner assembly 112. In other examples, the furnace 102 may include a pre-mixing unit (not shown) that mixes the airflow 132 and the fuel flow 138 before providing the air-fuel mixture to the burner assembly 112. In some examples, the fuel manifold 106 may be the same or similar to the fuel manifold 520 as described below with respect to FIGS. 5A-5C.

In some examples, one or more output signals of a sensor 122 are used to control the modulating gas valve 104. For example, one sensor 122 may be a pressure transducer that is used to generate one or more input command signals utilized to control the modulating gas valve 104. For example, the sensor may be a pressure transducer 122*c* for measuring pressure within the combustion flow path 134. The command signals from the pressure sensor 122, which may be transmitted to the modulating gas valve 104, are representative of a command for the modulating gas valve 104 to open a percentage, e.g., 50% of the modulating gas valve's fully opened position. In some examples, control circuitry 140 may include a map controller that correlates a voltage output signal, from the pressure transducer, representative of a pressure within the combustion flow path 134 to a position of the modulating gas valve 104, e.g., a percentage opened. In some examples, the modulating gas valve 104 may be the same or similar to the modulating gas valve 502 as described below with respect to FIGS. 5A-5C.

The inducer fan 118 as shown may be fluidly coupled, at least in part, to the air inlet 108, the burner assembly 112, the heat exchanger 114, the cold header 116, and the exhaust vent 120 via the combustion flow path 134. Further, the inducer fan 118 as shown may also be fluidly coupled to the cold header port 116*a* and/or the inducer port 118*a*. The inducer fan 118 may be configured, at least in part, to pull air from the air inlet 108 and fuel from a fuel inlet (not shown) into the burner assembly 112 via at least the combustion flow path 134. Further the inducer fan 118 may be configured to pull combusted by-products from the burner assembly 112 through, at least in part, the heat exchanger 114 and the cold header port 116*a* and then push the combusted flue products out of the furnace 102 to at least an outdoor environment through the exhaust vent 120. In some examples, the inducer fan 118 is located between the air inlet 108 and the burner assembly 112 to push the air flow through, at least in part, the heat exchanger 114 and the cold header port 116*a*.

In some examples, the inducer fan 118 may include one or more of a draft inducer fan, a blower, a motor, a speed sensor, a variable speed drive, a single speed drive, or the like. As shown, the inducer fan 118 may be communicatively coupled to the control circuitry 140, e.g., via the communication bus 128, to at least provide speed information to the control circuitry 140, e.g., a speed indication from a speed sensor of the inducer fan representative of rotations per minute (RPMs) or the like. In some examples, the control circuitry 140 may transmit command signals, e.g., control indications, to the inducer fan 118 or a component thereof, e.g., control the fan motor to increase/decrease RPMs. In some examples, the inducer fan 118 may further include some or all of the draft inducer fan 570 described in further detail below with respect to FIGS. 5A-5C.

The heat exchanger 114 may be any type of heat exchanger and it may exchange heat from the combustion by-products within the combustion path with an air flow 156 circulated by a circulation blower 150. In the depicted example, the heat exchanger 114 includes two heat exchangers arranged in series, indicative of a condensing heat exchanger, for example. The first heat exchanger 114*a* may be the primary heat exchanger. The second heat exchanger may be a condensing heat exchanger 114*b*, e.g., a secondary heat exchanger. Other configurations may be used as well as more or fewer heat exchangers.

The circulation blower 150 may circulate a circulation airflow 156 through the furnace 102 via pathway 158. In the depicted example, the furnace includes a conditioned air inlet 152, which allows air to follow into pathway 158. The furnace further includes a conditioned air outlet 154 which flows air out of the furnace. In some examples, the conditioned air inlet 152 and/or outlet 154 are connected to a duct network (not shown) to direct the air flow to and/or from a conditioned space. In addition, in the depicted example, pathway 158 directs the airflow 156 via a fluidly closed path such that the circulation air 156 does not mix with the fluid in the combustion flow path 134, while heat is still exchanged between these two fluid flows at heat exchanger 114.

In some examples, the circulation blower 150 may include one or more of a circulation blower, a fan, a motor, a speed sensor, a variable speed drive, a single speed drive, or the like. As shown, the circulation blower 150 may be communicatively coupled to the control circuitry 140, e.g., via the communication bus 128, to at least provide speed information to the control circuitry 140, e.g., a speed indication from a speed sensor of the circulation blower representative of rotations per minute (RPMs) or the like. In some examples, the control circuitry 140 may transmit command signals, e.g., control indications, to the circulation blower 150 or a component thereof, e.g., control the fan motor to increase/decrease RPMs. In some examples, the circulation blower 150 may further include some or all of the circulation blower 580 described in further detail below with respect to FIGS. 5A-5C.

In some examples, the furnace 102 may include various sensors 122, examples of which are shown in FIG. 1 and discussed herein. For example, a temperature sensor 122*a* and/or a humidity sensor 122*b* may be included within heat exchanger 114. In the depicted examples, the temperature sensor 122*a* and the humidity sensor 122*b* are located within the condensing heat exchanger 114*b*, however, it is understood that these sensors may be located elsewhere and/or multiple sensors may be included.

In addition, furnace 102 may also include a pressure transducer 122*c* as a sensor 122. The pressure transducer 122*c* as shown may be fluidly coupled to the exterior housing of the inducer fan 118 via the inducer port 118*a*, at least in part, to monitor the air pressure within the inducer fan 118 and/or within the combustion flow path 134. In some examples, the inducer port 118*a* may be the same or similar to the inducer port 570*a* of the draft inducer fan 570 described in further detail below with respect to FIGS. 5A-5C. In some examples, the pressure transducer 122*c* may be fluidly coupled to the cold header 116 via the cold header port 116*a*, at least in part, to monitor the air pressure within the cold header 116 and/or within the combustion flow path 134.

Further, as shown, the pressure transducer 122*c* may be communicatively coupled to the control circuitry 140, e.g., via the communication bus 128, to at least provide air pressure information to the control circuitry 140, e.g., a pressure indication representative of the air pressure, at least in part, within the combustion flow path 134. In some examples, the control circuitry 140 may transmit command signals, e.g., control indications, to the pressure transducer 122*c*, e.g., a command for the pressure transducer 122*c* to transmit a pressure indication to the control circuitry 140. In some examples, the pressure transducer 122*c* may include one or more of a potentiometric, inductive sensor, a capacitive sensor, a piezoelectric sensor, a strain gauge, a variable reluctance pressure sensor, a silicon transducer, a transmitter, or the like. For example, the pressure transducer 122*c*, as shown in at least FIG. 1, may be a silicon diode strain gauge pressure transducer.

In addition, furnace 102 may also include a pressure switch 122*d* as a sensor 122. The pressure switch 122*d* as shown may be fluidly coupled to the exterior housing of the inducer fan 118 via the inducer port 118*a*, at least in part, to monitor the air pressure within the inducer fan 118 and/or within the combustion flow path 134. In some examples, the pressure switch 122*d* may be fluidly coupled to the cold header 116 via the cold header port 116*a*, at least in part, to monitor the air pressure within the cold header 116 and/or within the combustion flow path 134. The pressure switch 122*d* as shown may be located proximate the interior space defined by the housing 110 of the furnace 102, at least in part, to monitor a reference air pressure within the interior space defined by the housing 110. In some examples, the pressure switch 122*d* may monitor both an air pressure within the combustion flow path 134 and a reference air pressure within the interior space defined by the housing 110. In some examples, other reference air pressures may be utilized, e.g., ambient outdoor air pressure or other air pressures exterior relative to the housing 110. In some examples, the pressure switch 122*d* may be an absolute pressure switch that does not require monitoring of a reference air pressure. In some examples, the pressure switch 122*d* may be coupled to one or more ports as described above via a signal tube.

The pressure switch 122*d* may be configured to open at a first pressure and to close at a second pressure. In some examples, the pressure switch 122*d* may be located, at least in part, within the combustion flow path 134, e.g., within the housing of the furnace 102. The pressure switch 122*d* may monitor the same or substantially the same pressures as the pressure transducer 122*c*, e.g., combustion flow path 134, and/or other pressures within the furnace 102. The pressure switch 122*d*, in some examples, may be fluidly coupled to the same port as the pressure transducer 122*c*, e.g., the inducer port 118*a* of the inducer fan 118 as shown. In other examples, the pressure switch 122*d* and the pressure transducer 122*c* may monitor different pressures of the furnace 102 and reference the same atmospheric pressure, e.g., so that each respective monitored pressure can be referenced to the same atmospheric pressure. In some such examples, the pressure switch 122*d* may be fluidly coupled to a different port than the pressure transducer 122*c*. For example, the pressure transducer 122*c* may be fluidly coupled to the inducer port 118*a* of the inducer fan 118 and the pressure switch 122*d* may be fluidly coupled to the cold header port 116*a* of the cold header 116.

Further, as shown, the pressure switch 122*d* may be communicatively coupled to the control circuitry 140, e.g., via the communication bus 128, to at least provide air pressure and/or switching information to the control circuitry 140, e.g., opened/closed indications representative of the pressure switch 122*d* being in an opened/closed switch position. In some examples, the control circuitry 140 may transmit command signals, e.g., control indications, to the pressure switch 122*d*, e.g., a command for the pressure switch 122*d* to transmit an indication representative of its current switch position. In some examples, the pressure switch 122*d* may include a pneumatic pressure switch comprising one or more of a capsule, bellows, Bourdon tube, diaphragm, piston, transmitter, or the like. For example, the pressure switch 122*d*, as shown in at least FIG. 1, may be a diaphragm pressure switch.

The control circuitry 140 as shown and described above may be communicatively coupled, at least in part, to the pressure transducer 122*c*, the pressure switch 122*d*, the modulating gas valve 104, the burner assembly 112, the inducer fan 118, and/or the circulation blower 150. Further, as shown, the control circuitry 140 may be communicatively coupled, at least in part, to the system controller 124 of the climate control system 100. In some examples, the control circuitry 140 may be directly or indirectly, e.g., via system controller 124, communicatively coupled to the thermostat 126, an indoor controller, an outdoor controller, or the like, to transmit and/or receive communication signals therewith. For example, the thermostat 126 may receive a request for a heating demand from a homeowner and then the thermostat 126 may transmit a demand indication representative of the heating demand request from the homeowner to at least the control circuitry 140 of the furnace 102. In some examples, the control circuitry 140 may include some or all of the control circuitry 600 described in further detail below with respect to FIG. 6. In some examples, the control circuitry 140 may include some or all of the control circuitry 590 described in further detail below with respect to FIGS. 5A-5C. In some examples, the control circuitry 140 may include some or all of the system controller 124 as described herein.

The combustion flow path 134 as shown may be configured, at least in part, to convey air from the outdoor environment through the furnace 102 to facilitate the combustion reaction process as described in further detail below. The combustion flow path 134 as shown may be further configured, at least in part, to convey combustion byproducts through the furnace 102 to the outdoor environment. In some examples, the pressure (and fluid flow) within the combustion flow path 134 may be at least partially controlled by the inducer fan 118. For context, the inducer fan 118 may create at least partially a negative, e.g., suction, pressure in the combustion flow path 134 between the air inlet 108 and the inducer port 118*a*. Further, the inducer fan 118 may create at least partially a positive, e.g., blowing, pressure in the combustion flow path 134 between the inducer fan 118 and the exhaust vent 120. Furthermore, the pressures in the conduit may be, at least in part, proportional to the speed of the inducer fan 118 and/or the environmental conditions, e.g., high winds, acting on the air inlet 108 and/or the exhaust vent 120. The combustion flow path 134 as shown may comprise one or more of a pipe, duct, tube, joint, sealant, gaskets, or the like.

The system controller 124 may also generally comprise an input/output (I/O) unit, e.g., a graphical user interface, a touchscreen interface, or the like, for displaying information and for receiving user inputs. The system controller 124 may display information related to the operation of the climate control system 100 and may receive user inputs related to operation of the climate control system 100. However, the system controller 124 may further be operable to display information and receive user inputs tangentially related and/or unrelated to operation of the climate control system 100. In some examples, the system controller 124 may not comprise a display and may derive all information from inputs that come from remote sensors and remote configuration tools. In some examples, the system controller 124, control circuitry 140, thermostat 126, or the like may be configured for selective bidirectional communication over the communication bus 128, which may utilize any type of communication network. For example, the communication may be via wired or wireless data links directly or across one or more networks, such as a control network. Examples of suitable communication protocols for the control network include CAN, TCP/IP, BACnet, LonTalk, Modbus, ZigBee, Zwave, Wi-Fi, SIMPLE, Bluetooth, and the like. In some examples, the system controller 124 may include in whole or in part the control circuitry 140 as described above with respect to FIG. 1. In some examples, the system controller 124 may include in whole or in part the control circuitry 600 as described below with respect to FIG. 6.

Now that the general structure of example climate control systems, including example furnaces, have been walked through in detail above, the below will walk through an example of the process for improving furnace efficiency with reference to FIG. 2.

Figure 2:
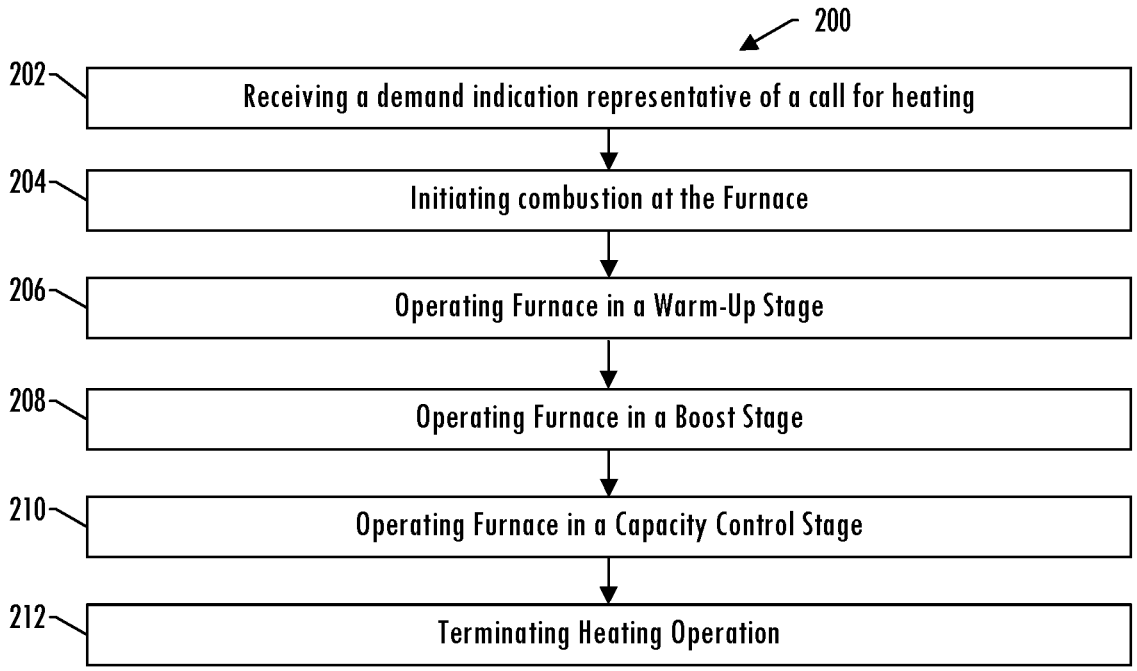
FIG. 2 illustrates a flow chart for operating a furnace, according to some example implementations of the present disclosure.

FIG. 2 provides an example flow chart for the efficiency process 200 described herein. As discussed above, and shown in FIG. 2, the process may include receiving a demand indication representative of a call for heating at step 202. At step 204, the process 200 may include initiating combustion of a fuel source at the furnace. The furnace may also initiate a warm-up stage as part of the process 200 at step 206. The process 200 may also initiate a boost stage for the furnace at step 208, and a capacity control stage at step 210. The process 200 may also terminate heating operation at step 212, potentially after a heating demand has been satisfied. Each of these process steps will be described in more details, and the methods and systems described herein may utilize more or less of these process steps.

In some examples, the process 200 is initiated when a demand for heating is received, e.g., a call for heating, at step 202. This call for heating may be based on any process. For example, it may be based on a sensed temperature of a conditioned space serviced by the furnace being lower than a temperature set point. Other methods may include determining a heating demand based on load calculations or monitoring outdoor conditions. Still other demands for heating may be utilized, and once received or determined, the process 200 may initiate the process of delivering heat from the furnace.

In some examples, the process 200 further includes initiating combustion at step 204. The process 204 of initiating combustion may including setting a firing rate for combustion. This firing rate may be an intermediate firing rate, e.g., a firing rate being greater than a minimum firing rate and less than a maximum firing rate. Setting the furnace to an intermediate firing rate to initiate combustion of the furnace may have certain advantages. For example, this firing rate may ensure initial combustion is appropriately achieved, which is important for safe operation of the furnace. This firing rate can also result in a lower inducer (118) speed, which will reduce the noise level of the furnace. In addition, the ignition process can result in excessive fuel consumption, potentially without any benefit for the conditioning process. As a result, too high of a firing rate may result in wasted fuel consumption. In the present process, these factors, and others are considered in determining the appropriate firing rate for the burner assembly to achieve initial combustion, e.g., ignition.

In some examples, the firing rate at initial combustion may be a pre-selected firing rate for the furnace. For example, the intermediate firing rate, which may be used for initial combustion, may be determined based on testing and calibration of a given furnace design to optimize combustion ignition, e.g., initial combustion. This may occur during the design and development of the furnace, and/or it may be done during the calibration/commissioning process for the furnace. In some examples, the pre-selected firing rate may be determined during installation for the furnace.

In some examples, the pre-selected firing rate for initial combustion, e.g., the intermediate firing rate, may be updated after installation. For example, a technician may update the firing rate based on upgraded equipment, changes to fuel sources, or additional data regarding the furnace's make or model. In other examples, data associated with the furnace operation may be used to update the pre-selected firing rate.

In some examples, the firing rate used for initial combustion, e.g., the intermediate firing rate, may be between 55% and 75%. In some examples, this initial firing rate may be about 65%. In these examples, the percentage refers to the percentage of fuel flow from a maximum, rated fuel flow, e.g., 65% of the rated fuel flow for the furnace. In some examples, this percentage of fuel flow correlates to a valve position, e.g., 65% fuel flow correlates to a gas valve, e.g., modulating gas valve 104, being 65% open. Additionally, gas valve settings will differ between gases such as natural gas and propane. While natural gas may be set at 65% open, propane would use a 70% open setting. It is understood that this correlation may not be exact, but may be approximately equivalent.

In some examples, the process 200 may also include operating the furnace in a warm-up stage as shown in step 206. In this warm-up stage, the furnace may operate the burner assembly along with the inducer fan. During the warm-up stage, the circulation blower may be maintained in an off state. In some examples, this warm-up stage is directed to increasing the temperature of the heat exchanger within the furnace before activating the circulation blower. This may improve the overall efficiency, and it also may prevent any instance of the furnace blowing cold air into the conditioned space, sometimes referred to as "cold blow."

During the warm-up stage the burner assembly may be controlled to maintain the firing rate set for initial combustion, e.g., the intermediate firing rate, at ignition. This setting may be advantageous because it maintains the optimization discussed above, e.g., fuel consumption and stable combustion. In some examples, the firing rate may be increased during the warm-up stage to expedite the increase of the temperature of the heat exchanger. For example, the firing rate during the warm-up stage may be increased by a certain amount and/or increased to the maximum setting. During the warm-up stage, the inducer fan may continue to operate and the operation for the inducer fan may be related to the firing rate as discussed throughout the disclosure herein, e.g., mapping, pressure control, pneumatic control, etc.

Further, the warm-up stage may continue for a set period of time and/or until one or more conditions are meet. For example, the warm-up stage may be designed to heat the heat exchanger of the furnace to a certain temperature prior to initiating the circulation blower. Thus, in some examples, the warm-up stage may continue until a temperature is achieved within the heat exchanger. This may be determined based on a temperature sensor located in the heat exchanger, or through another process. In some examples, the warm-up period lasts for a certain period of time. This period of time may be determined to allow for the heat exchanger to reach an appropriate temperature or based on other considerations. In some examples, the warm-up stage lasts for about 30 seconds, in other examples, the period of time is more or less.

In some examples, the period of time for the warm-up stage may be determined as part of a calibration or commissioning process, similar to the process for determining the firing rate for combustion discussed above. In addition, in some examples, the period of time for the warm-up stage may be adjusted during installation and/or after operation, again in a manner similar to the process discussed above regarding setting a firing rate for initial combustion, e.g., light-off or ignition.

In some examples, the process 200 may also include operating the furnace in a boost stage as shown in step 208. In this boost stage, the process may initiate the operation of the circulation blower, and it may also continue to operate the burner assembly and the inducer fan. In some examples, this boost stage is directed to increasing the heat transfer between the combustion by-products and the conditioned air circulated through the furnace. In some examples, the furnace is a condensing furnace, and the boost period is designed to initiate condensation in the secondary heat exchanger, which may improve the overall efficiency of the furnace during a given heating cycle.

During the warm-up stage, the burner assembly may be controlled to continue to maintain the firing rate set for initial combustion, e.g., the intermediate firing rate. Similar, to the above warm-up stage, the firing rate set for initial combustion may be advantageous for the reasons discussed above. Further, in some examples, the firing rate is increased during the boost stage, potentially by a certain percentage or amount and/or to the maximum setting. During the boost stage, the inducer fan may continue to operate and the operation for the inducer fan may be related to the firing rate as discussed therein.

Further, the circulation blower may be initiated during the boost stage and continue operation during the boost stage. In some examples, the initiation of the circulation blower may start the boost stage. In some examples, the circulation blower may start at full speed during the boost stage. In some examples, the circulation blower is controlled to establish a set discharge temperature for the conditioned air leaving the furnace, e.g., about 110° F. In some examples, the circulation blower is controlled to establish a set temperature rise, e.g., about 20° F. Other control processes may be utilized for the circulation blower during the boost stage.

In some examples, the boost stage lasts for a certain period of time and/or until a certain condition is meet. In some examples, the boost stage is designed to allow for condensation of the combustion by-products to occur within the heat exchanger. Again, the occurrence of this condensation may allow for an improved heat transfer from the heat generated at the burner assembly and the circulation air. For example, the occurrence of condensation within the heat exchanger may result in 90% or more of the heat generated by the fuel combusted at the burner assembly being transferred to the circulation air at the heat exchanger. In some examples, the heat transfer is greater than 97% or even higher.

In these examples, the boost stage may be set to allow for this higher heat transfer to be established. Thus, in some examples, the boost stage may operate for a set period of time, and this set period of time may be determined to allow for higher heat transfer to occur. For example, the boost stage may last for at least a threshold period of time, e.g., at least 5 seconds. In some examples, the boost stage lasts for a period of time, e.g., 90 seconds. Other time periods may be used, and again, these time periods may be determined through various methods, including testing, calibration, calculations, commissioning, etc. In some examples, this set period of time may be adjusted, potentially by an operator. This adjustment may be made to further optimize the boost period. For example, additional information regarding the furnace type, e.g., make/model, operation, installation location, etc., may indicate that the boost period should be adjusted. This adjustment may be made before, during, or after installation. Further, an operator, e.g., homeowner, technician, etc., may make the adjustment or the system may adjust this set period based on other processes, e.g., software update, learning algorithms, etc.

In some examples, the boost stage may operate for a variable period of time, potentially until a certain condition is established. For example, the process 200 may determine whether condensation has occurred within heat exchanger. This may be determined by any method. For example, the furnace may include a temperature sensor within the heat exchanger, potentially within the secondary heat exchanger. Based on readings from the temperature sensor, the system may determine whether (or not) condensation has occurred within the heat exchanger. In some examples, a humidity sensor may be utilized to determine whether condensation has occurred. In some examples, pressure and/or pressure drop through the heat exchanger, potentially just the secondary heat exchanger is determined. In some examples, the pressure sensor and/or pressure switch discussed above in connection with FIG. 1 are used to monitor pressure. In some examples, the pressure measurements may also be used to determine if condensation has formed within the condensing heat exchanger and/or the level of thermal heat transfer that is being achieved at the heat exchanger. Other sensors or techniques may also be used.

In some examples, the boost stage may operate until the circulation air reaches a certain temperature or temperature rise. For example, the boost stage may continue to operate until the discharge temperature of the circulation air is at or above a given valve, e.g., 110° F. In some examples, the boost stage may continue to operate until the temperature rise of the circulation air is at or above a given value, e.g., 20° F.

In some examples, during the boost stage the circulation blower may operate in a circulation boost operation. For example, the circulation blower may operate at a higher level, e.g., a level above what would correlate to the firing rate during a capacity control setting. By operating the circulation blower at a higher rate, the heat transfer at the heat exchanger may be increased, and in some examples, this may allow condensation of the combustion by-products to occur at a faster rate.

It is understood that in some examples, the process 200 may continue the boost stage until two or more of the conditions described above are meet. For example, the boost stage may end when more than one of these conditions is met. For example, the boost stage may continue until both a given period of time has expired and condensation has formed in the secondary heat exchanger and/or a given threshold discharge circulation air temperature has been achieved. Other combinations may also be used to determine when the boost stage 208 ends and the process 200 adjusts to another stage, potentially the capacity control stage 210.

In some examples, the process 200 may also include operating the furnace in capacity control mode as shown in step 210. During this stage, the furnace may operate the burner assembly, the inducer fan, and the circulation blower. In some examples, each of these components are controlled based on the heating demand received by the system, and in some examples, the components are controlled to match or exceed the heating capacity to satisfy the demand.

For example, in the capacity control mode, the firing rate may be based on the demand for heating. If the space requires a certain amount of heating, e.g., British Thermal Units per Hour (BTU/hr), to satisfy a temperature set point and/or conditioning load, then the firing rate may be set based on that heating demand. In some cases, the firing rate for the burner assembly may be set above that heating demand. In some examples, the firing rate may be set based on other conditions, e.g., temperature deviation from a setpoint, etc. In some examples, the firing rate may generally be set based on a relationship to the underlying demand.

Similarly, and as discussed in other sections, the inducer fan may be set based on the firing rate. It is understood that this relationship may also be reversed such that inducer fan speed/control is based on a heating demand and firing rate may be set based on inducer fan speed/control.

The circulating blower may also be operated during the capacity control mode to address a heating demand. In some examples, the circulation blower may adjust its operation from the boost mode during the capacity control mode, potentially based on the heating demand. In some examples, the circulating blower may be operated at a given level to provide a certain discharge air temperature or temperature rise. In some examples, the circulation blower may be operated based on a heating demand. In these examples, the circulation blower may provide a given air flow rate based on the heating demand, and the burner assembly/inducer fan may be operated to meet a given discharge air temperature and/or temperature rise. Other control processes may also be utilized to control the burner assembly, inducer fan, and circulation blower to meet the heating demand.

Further, in some examples, the process 200 described herein may be particularly well suited for a capacity control stage directed to low-capacity settings. This is because at lower capacity settings the furnace may not be able to reach peak combustion efficiency and/or may reach peak efficiency late in the heating cycle. In addition, furnaces, particularly modulating furnaces, may cycle more often at lower load conditions making this efficiency loses more pronounced for the overall operation of the furnace.

In these examples, low-capacity settings may be any settings where the furnace is operating at less than the maximum capacity setting. In some examples, low-capacity settings are settings where the firing rate for the given heating demand requested is less than the intermediate firing rate. In some examples, the firing rate at the low-capacity settings may be less than a required firing rate used for ignition for the furnace. For example, the firing rate at the low-capacity setting may provide less fuel that would be appropriate for stable and reliable ignition. In some examples, the furnace may have an ignition firing rate set and/or a minimum ignition firing rate, and the firing rate at the low-capacity setting may be less than that setting. In some examples, the firing rate at the low-capacity setting may be the minimum firing rate.

In some examples, the process 200 may also include terminating heating operation at step 212. The heating process may be terminated for any reason. For example, the demand for heating may be satisfied. In some examples, an issue may arise during the heating operation, e.g., component failure, power failure, etc., which may result in terminating the heating operation. Other causes may also lead to the heating operation being stopped.

Figure 3:
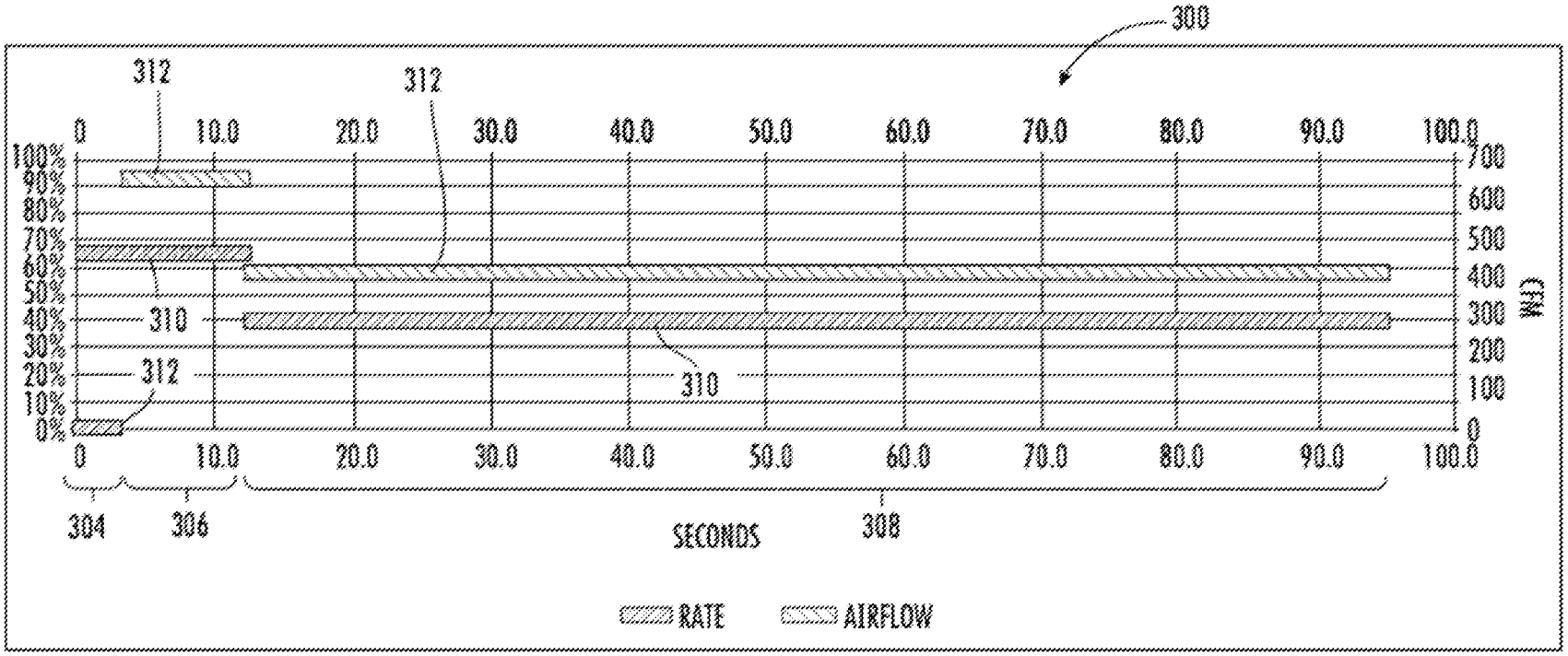
FIG. 3 illustrates a chart for various furnace operations, according to some example implementations of the present disclosure.

To walk through a further example of the warm-up stage (step 204), the boost stage (step 206), and the capacity control stage (step 208) reference is made to chart 302 in FIG. 3. In the depicted chart, the warm-up stage is represented in time period 304, the boost stage is represented in time period 306, and the capacity control stage is represented in time period 308. The warm-up stage (304), the boost stage (306), and the capacity control stage (308) discussed in connection with FIG. 3 may be the same or substantially the same as the warm-up stage (204), the boost stage (206), and the capacity control stage (208) discussed in connection with FIG. 2.

Chart 302 walks through an example control process for the burner assembly and the circulation blower. The burner assembly firing rate is represented by line 310, and in this depicted example, as a firing rate percentage (0%-100%). The circulation blower control is represented by line 312, and in this depicted example, the circulation blower control is an air flow rate shown in cubic feet per minute (CFM) for the circulation blower (0 CFM-700 CFM). It is understood that while the inducer fan control is not shown in FIG. 3, the controls for that component will be related to the burner assembly control.

In the depicted example, the warm-up stage is shown as the first time period, 304. In this example, the warm-up stage runs for approximately 30 seconds. During that stage, the circulation blower is set to 0 CFM, e.g., it is not operating/circulating air. In addition, the firing rate is set to 65% for the burner assembly. As discussed above, this firing rate may be the same or substantially same as the firing rate set for initiating combustion of the furnace. For example, time T=0 may start after a flame has been established at the burner assembly.

In the next time period, 306, the boost stage is shown. In the depicted example, the circulation blower is turned on to 700 CFM, starting the boost stage in this example. In this example, the firing rate for the burner assembly is maintained at 65%, and the boost stage continues for 90 seconds.

Following the boost-stage in this example, the capacity control stage is initiated at 308. In this stage, both the firing rate 310 for the burner assembly and the flow rate for the circulation blower 312 are adjusted down. As discussed above, this adjustment down may be based on the existing heating demand call. In the depicted example, the firing rate is adjusted down to 40%, which may be the minimum firing rate. In addition, the circulation blower is adjusted down to 400 CFM. The flow rate for the circulation blower in this example may be the minimum flow rate for that blower and/or it may be the flow rate to match a desired discharge temperature or temperature rise for the set firing rate.

Again, it is understood that the inducer fan operates while the burner assembly is operating, and that the inducer fan is controlled based on firing rate. It is also understood that different examples may utilize different control values and/or different time periods.

Now that the general processes for improving the efficiency of the furnace have been walked through above with reference to FIG. 3, we will walk through some additional example processes with reference to FIGS. 4A-4E.

FIGS. 4A-4E show an example process 400 that may be used to control a furnace and improve the efficiency of the furnace operation. This process 400 may be carried out, at least partially, by one or more apparatuses, components, circuits, and/or the like according to some examples of the present disclosure. In some examples, the process 400 may utilize one or more other components coupled to the control circuitry including without limitation the burner assembly, the inducer fan, the circulation blower, the sensors, and/or any other components of a climate control system and/or furnace as described herein. In some examples, the process 400 may, at least in part, be included in a learning routine, e.g., as an algorithm, executable program code, or the like, and may be stored on the control circuitry. In some examples other steps and/or processes as described herein may be incorporated into the process 400, e.g., one or more steps of the process 300 as described above.

The process 400 may be directed to controlling a furnace to improve efficiency, the furnace may include a heat exchanger, an inducer fan, a burner assembly, and a circulation blower. The process may include initiating combustion of a fuel in the burner assembly at an intermediate firing rate, as shown at step 402 of FIG. 4A. In some examples, the intermediate firing rate may be greater than a minimum firing rate and less than a maximum firing rate. The process may also include operating the furnace in warm-up stage for a first period of time following initiating the combustion of the fuel, as shown at step 404. In some examples, the warm-up stage includes operating the burner assembly at the intermediate firing rate, operating the inducer fan, and maintaining the circulation blower in an off state. The process may further include operating the furnace in a boost stage for a second period of time following the first period of time, as shown at step 406. In some examples, the boost stage includes operating the burner assembly at the intermediate firing rate, operating the inducer fan, and initiating operation of the circulation blower. Further, the process may include operating the furnace in a low-capacity setting following the second period of time, as shown in step 408. In some examples, the low-capacity setting includes operating the burner assembly at a low-capacity firing rate, operating the inducer fan, and continuing operation of the circulation blower at a rate corresponding with the low-capacity firing rate, the low-capacity firing rate being a lower firing rate than the intermediate firing rate.

Figure 4A:
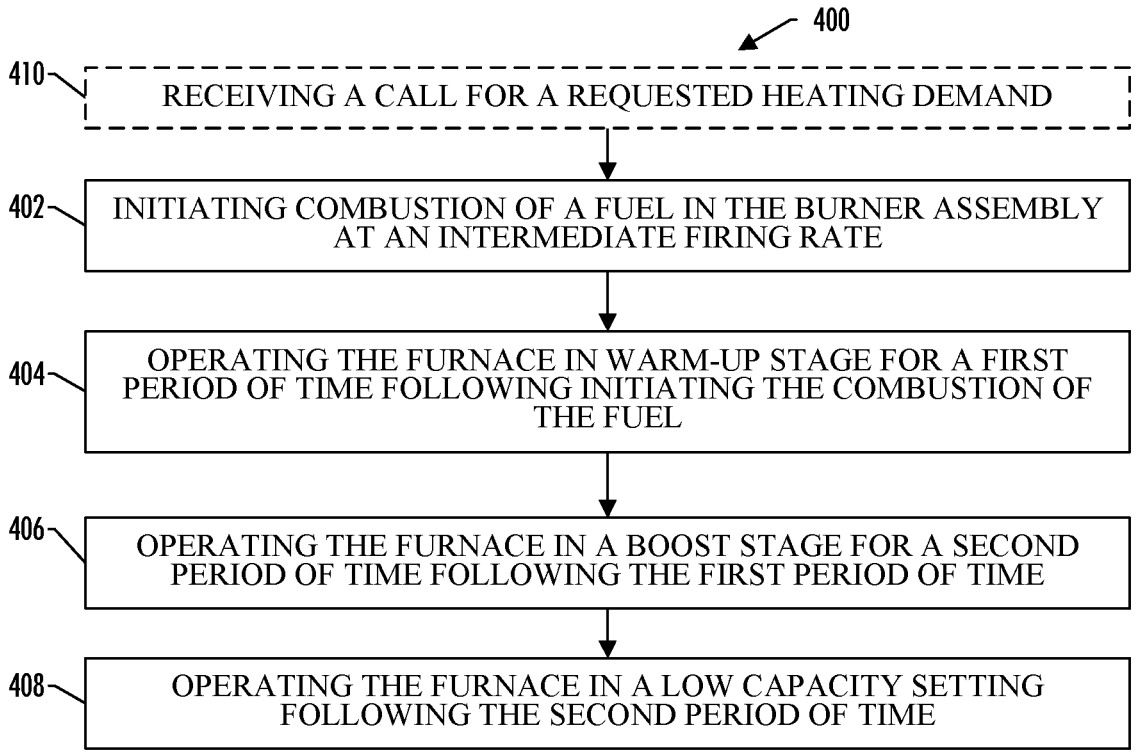

In some examples, the process 400 also includes receiving a call for a requested heating demand, as shown in step 410 of FIG. 4A. In some examples, the low-capacity firing rate is based on the requested heating demand from a conditioned space. In these examples, the process may also including adjusting the operation of the circulation blower based on the requested heating demand.

Figure 4B:
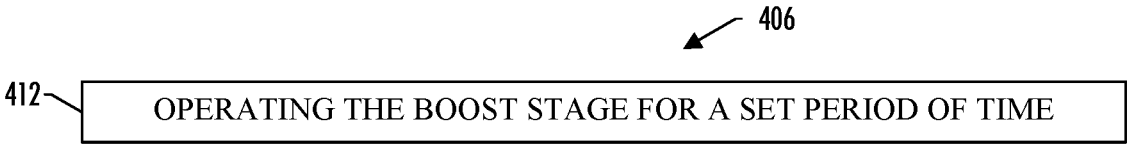

In some examples, the process 400 includes operating the boost stage 406 for a set period of time, as shown in step 412 in FIG. 4B. This set period of time may be greater than 5 seconds in some examples. In some examples, the set period of time is based on the furnace type associated with the furnace, the furnace type being one of the furnace make or model. As discussed, above, the set period of time may be determined based on testing or calibration of the furnace and/or of a similar furnace, e.g., the same make or model furnace. Other examples for determining the set period of time for the furnace make or model are discussed above.

Figure 4C:
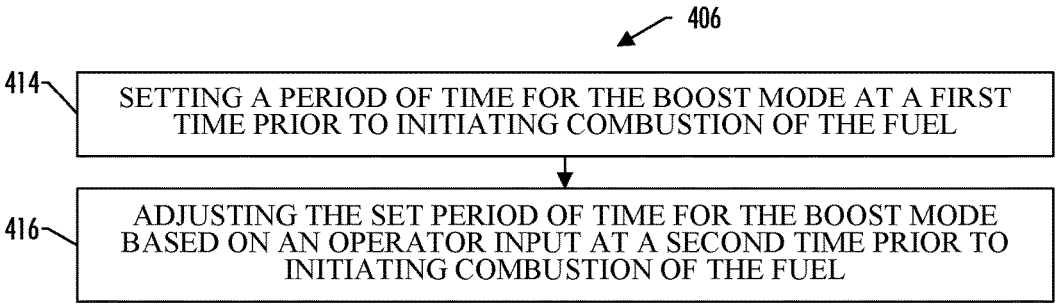

In some examples, the process 400 includes setting a period of time for the boost mode at a first time prior to initiating combustion of the fuel, as shown in step 414 in FIG. 4C. In some examples, the process also includes adjusting the set period of time for the boost mode based on an operator input at a second time prior to initiating combustion of the fuel, as shown in step 416. In these examples, the second time may be after the first time. To walk through a further example, the boost stage may be set to be 90 seconds at a first period of time, potentially during installation of the furnace. At another period of time after the installation it may be determined that a longer boost stage is appropriate for the furnace. The boost stage may then be adjusted to a longer period of time, e.g., 120 seconds. This adjustment may occur by an operator or through a different process.

Figure 4D:
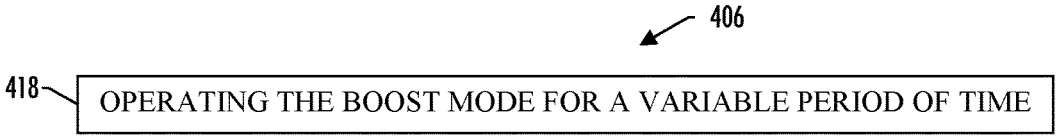

In some examples, the process 400 may include operating the boost mode at step 406 for a variable period of time, as shown in step 418 in FIG. 4D. In these examples, the second period of time may end based on the occurrence of a furnace condition. In some examples, the furnace condition is an indication condensate has formed in a heat exchanger. Other conditions may also be utilized to determine the time period for the boost mode, and in some examples more than one condition may be used.

Figure 4E:
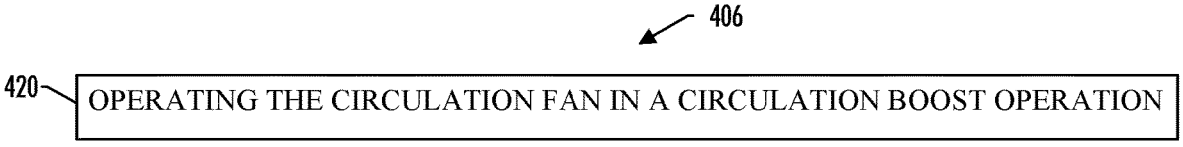

In some examples, the process 400 may include operating the boost mode at step 406 to include operating the circulation fan in a circulation boost operation, as shown in step 420 in FIG. 4E. This circulation boost operation may include operating the circulation blower at a higher level while the heat transfer between the combustion by-products and the circulation air increases at the heat exchanger.

FIGS. 5A-5C illustrate an example furnace 500. As discussed herein, a furnace, e.g., furnace 500, may be referred to as being "gas-fired," where the "gas-fired" furnace is configured to be in fluid communication with a gas flow, e.g., including fuel and/or air, for thermodynamic heat transfer and where the gas-flow comprises products of a combustion reaction from at least a burner. In some examples, a furnace 500 may comprise a component of a climate control system that includes an indoor unit comprising a furnace 500 and an indoor refrigerant heat exchanger or evaporator, an outdoor unit comprising an outdoor fan and an outdoor refrigerant heat exchanger or condenser, and a refrigerant loop extending between the indoor and outdoor refrigerant heat exchangers. The furnace 500 may be configured as an indoor furnace that provides conditioned air to a comfort zone of an indoor space. However, in general, the components of the furnace 500 may be equally employed in an outdoor or weatherized furnace to condition an interior space. Moreover, the furnace 500 may be used in residential and/or commercial applications.

As shown in FIG. 5A, the furnace 500 may generally include a modulating gas valve 502, a fuel manifold 520, a partition panel 530, a burner assembly 540, a plurality of heat exchangers 550, a hot collector box 560, and a first fan or draft inducer fan 570. Additionally, the burner assembly 540 may be positioned between the fuel manifold 520 and the heat exchangers 550, where the heat exchangers 550 may extend from burner assembly 540 to hot collector box 560.

The furnace 500, as shown, uses a plurality of burners 542 configured as in-shot burners, where the air for combustion is pulled into each respective burner between the gaps next to the fuel nozzles (not shown) coming off the fuel manifold 520. In such examples, the air and fuel used for the combustion process enter each in-shot burner separately and are combined to produce an air-fuel mixture within each respective burner.

In some examples, the fuel may be natural gas, or the like, available from the modulating gas valve 502 attached and operatively engaged with an external fuel line (not shown), e.g., gas utility meter. The modulating gas valve 502 may be configured to be adjusted, such as electrically or pneumatically, so as to obtain a desired and/or predefined air-to-fuel ratio. As will be discussed further herein, the modulating gas valve 502 may be configured for staged operation and/or modulation type operation, and may be operatively connected to control circuitry 590, as shown schematically in FIG. 5B, of the furnace 500. For example, staged operation may comprise two flame settings, whereas modulation type operation may be incrementally adjustable over a large range of outputs, such as, for example, from 40% to 100% output capacity.

While the furnace 500 as shown in FIGS. 5A-5C comprises in-shot burners configured to mix air and fuel within each respective burner, in other examples, the furnace 500 may include an air-fuel mixing unit (not shown) and may instead be configured to mix the fuel and air within the air-fuel mixing unit before conveying the air-fuel mixture to the burners 542 of the burner assembly 540. In such examples, the furnace 500 may include the air-fuel mixing unit before the fuel manifold 520 that is configured to allow at least partial mixing of fuel and air before entering the burners for the combustion reaction process. Such an air-fuel mixing unit may receive air via an air inlet (not shown) and fuel via the modulating gas valve 502 to allow at least partial mixing of the fuel and air in a predefined and/or dynamically adjustable ratio, e.g., controlled, at least in part, by the control circuitry 590.

The fuel manifold 520 of the heat exchanger 550 may generally include a flow distributor 522 extending from an inlet of fuel manifold 520 coupled with modulating gas valve 502. In some examples, the fuel manifold 520 may also include a plurality of heat exchanger supply tubes extending from flow distributor 522 to an outlet of fuel manifold 520 coupled with a heat exchanger 550.

The burner assembly 540 of a furnace 500 may include a plurality of burners 542 and at least one igniter 544 (as shown schematically in FIG. 5B). Each burner 542 of the burner assembly 540 may be supplied with fuel from the flow distributor 522 of fuel manifold 520. Additionally, each burner 542 of the burner assembly 540 may be supplied with air through a gap between the flow distributor 522 of the fuel manifold 520 and the respective burner 542. In some examples, the air may be pulled into each burner from within an interior space defined by a sealed housing (as shown in FIGS. 1-2) of the furnace 500. In such examples, the air may be pulled into each burner by a negative pressure generated, at least in part, by the draft inducer fan 570. The igniter 544 of the burner assembly 540 may be positioned at an opening of each burner 542 and may be configured to induce a combustion reaction by igniting a gas flow passing in and/or by the burners 542, where the gas flow may comprise air and/or fuel. Particularly, the gas flow may initially take the form of air and fuel that is at least partially mixed and/or un-combusted, e.g., not yet ignited or undergone a combustion reaction. As the gas flow travels through the fuel manifold 520 and the burners 542, the igniter 544 of the burner assembly 540 may initiate a combustion reaction. Combustion may occur at least partially within an interior space of each burner 542 so that heat is generated and forced out of the open end of the burner 542 and into a respective heat exchanger tube 558. In some examples, the igniter 544 may comprise any of a pilot light, a piezoelectric device, a spark igniter, and/or a hot surface igniter. The igniter 544 may be controlled by control circuitry 590 of furnace 500.

As shown in FIG. 5C, the heat exchanger 550 of furnace 500 has at least a first end 552 coupled to partition panel 530 and at least a second end 554 coupled to hot collector box 560. The heat exchanger 550 may comprise an exterior surface 556 (as indicated in FIG. 5B) and a plurality of heat exchanger tubes 558 extending between the first end 552 and the second end 554. In the depicted examples, each heat exchanger tube 558 is a bent, S-shaped tube that extends through a tortuous path to enhance the surface area available for heat transfer with the surrounding circulation air. However, in other examples, the configuration of the heat exchanger 550 may vary. In some examples, a finned condensing heat exchanger 565 may extend from the hot collector box 560 to the cold header 598 and/or the draft inducer fan 570. As shown, the cold header 598 is configured with a cold header port 598*a* which may be fluidly coupled, e.g., with a signal tube, to a pressure switch and/or pressure transducer as described above. Additionally, the cold header 598 may include a cold header port 598*a* that may, at least in part, be fluidly coupled the cold header 598 to one or more pressure sensors, transducers, and/or switches. In some examples, the cold header port 598*a*, or the like as described above, may be coupled to one or more signal tubes, e.g., via a manifold or the like, in order to fluidly couple the cold header port 598*a* to multiple pressure sensing devices, e.g., at least a pressure transducer and a pressure switch. However, generally, the furnace 500 may be operated with or without a condensing heat exchanger as a "condensing" or "non-condensing" furnace, respectively.

As shown in FIG. 5A, the gas flow may follow a combustion flow path (indicated, at least in part, by combustion flow path 572) that may be in a direction beginning at the air inlet gap of each of the burners 542 and ending at the draft inducer fan 570. For example, the combustion flow path 572 may follow from the burners 542 and through heat exchanger tubes 558 of heat exchanger 550. The combustion flow path 572 may continue through the hot collector box 560 and the condensing heat exchanger 565, and may exit past the draft inducer fan 570 towards a designated venting environment (not shown in FIGS. 5A-5C). It is understood that there may be more or less components of the furnace 500 in fluid communication with the combustion flow path 572.

In some examples, the gas flow described above may be introduced into the furnace 500 by operating in an induced draft mode by pulling the gas flow, e.g., fuel and/or air, through the furnace 500 via the draft inducer fan 570, or by operating in a forced draft mode by pushing the gas flow through the furnace 500. As shown, the draft inducer fan 570 may comprise a blower which is in fluid communication with the combustion flow path 572 and is down-stream of the heat exchanger 550. Additionally, the draft inducer fan 570 may include a inducer port 570*a* that may, at least in part, be fluidly couple the draft inducer fan 570 to one or more pressure sensors, transducers, and/or switches. In some examples, the inducer port 570*a*, or the like as described above, may be coupled to one or more signal tubes, e.g., via a manifold or the like, in order to fluidly couple the inducer port 570*a* to multiple pressure sensing devices, e.g., at least a pressure transducer and a pressure switch. The draft inducer fan 570, as shown, may pull and/or extract the gas flow, e.g., combusted flue products, out from the heat exchanger 550 by creating a relatively lower pressure at one end of the combustion flow path 572. In other examples, using a forced draft mode may be accomplished by placing a blower and/or fan at the inlet of an air-fuel mixing unit (not shown) and forcing the gas flow into and through the air-fuel mixing unit and along a combustion flow path, e.g., 572. In the depicted examples of FIGS. 5A-5C, the draft inducer fan 570 is configured with an inducer port 570*a* which may be fluidly coupled, e.g., with a signal tube, to a pressure switch and/or a pressure transducer as described above.

As shown particularly in FIG. 5B, in addition to the partition panel 530, the furnace 500 may also include a first side panel 532 and a second side panel 534. These panels 530, 532, and 534 may be disposed in a configuration such that fluids, e.g., air, which contact an exterior surface of a component of the furnace 500, e.g., fluid passing over the exterior surface 556 of heat exchanger 550 for thermodynamic heat transfer, are segregated from the gas flow circulating along combustion flow path 572.

The furnace 500 may further include a second or circulation fan 580. The circulation fan 580 may be configured to receive an inlet airflow 582 and force or drive the inlet airflow 582 into contact with the exterior surface 556 of the heat exchanger 550. In other examples, the circulation fan 580 may draw the airflow 582 across the exterior surface 556 of heat exchanger 550. In response to the inlet airflow 582 contacting the heat exchanger 550, heat may be transferred from the gas flow circulating within the heat exchanger 550 to the inlet airflow 582, thereby heating the inlet airflow 582. Following contact with the heat exchanger 550, the airflow may exit the furnace 500 as an outlet for the conditioned airflow 584, which may have a temperature that is greater than a temperature of the inlet airflow 582. Conditioned airflow 584 may be delivered to a comfort zone of an indoor space.

In some examples, the circulation fan 580 may comprise a centrifugal blower comprising a blower housing 581, and a motor 583 configured to selectively rotate a blower impeller (not shown) of the circulation fan 580 that is at least partially disposed within the blower housing 581. In other examples, the circulation fan 580 may comprise a mixed-flow fan and/or any other suitable type of fan. The circulation fan 580 may be configured as a modulating and/or variable speed fan capable of being operated at many speeds over one or more ranges of speeds. In other examples, the circulation fan 580 may be configured as a multiple speed fan capable of being operated at a plurality of operating speeds by selectively electrically powering different ones of multiple electromagnetic windings of the motor 583 of the circulation fan 580.

As shown particularly in FIG. 5B, the furnace 500 may comprise control circuitry 590 for controlling one or more components of the furnace 500. Generally speaking, the controller 590 is coupled to various components of the furnace 500 as well as various sensors configured to detect various operating parameters within furnace 500. For example, in some examples, the control circuitry 590 of furnace 500 may communicate with and/or otherwise affect control over the modulating gas valve 502, the igniter 544 of the burner assembly 540, the draft inducer fan 570, and/or the circulation fan 580. Additionally, control circuitry 590 may control the draft inducer fan 570 to provide an adequate gas flow, e.g., fuel and/or airflow, along the combustion flow path 572 for a desired firing rate through the burner assembly 540.

Control circuitry 590 may comprise a singular controller or control board or may comprise a plurality of controllers or control boards that are coupled to one another. For example, control circuitry 590 may comprise a distinct control board positioned on a panel, e.g., panels 530, 532, and/or 534, of the furnace 500 and/or a control board positioned within the motor 583 of the circulation fan 580. For convenience, and to simplify the drawings, control circuitry 590 is depicted schematically in FIG. 5B as a single controller unit that is coupled to various components within the furnace 500. Particularly, control circuitry 590 may comprise a processor 592 and a memory 594. The processor 592 (e.g., microprocessor, central processing unit (CPU), or collection of such processor devices, etc.) executes machine-readable instructions 596 provided on memory 594 (e.g., non-transitory machine-readable medium) to provide the control circuitry 590 with all the functionality described herein. The memory 594 may comprise volatile storage (e.g., random access memory (RAM)), non-volatile storage (e.g., flash storage, read-only memory (ROM), etc.), or combinations of both volatile and non-volatile storage. Data consumed or produced by the machine-readable instructions 596 can also be stored on the memory 594. As noted above, in some examples, control circuitry 590 may comprise a collection of controllers and/or control boards that are coupled to one another. As a result, in some examples, the control circuitry 590 may comprise a plurality of processors 592, memories 594, etc.

As described above, a climate control system including an indoor unit and an outdoor unit may include the furnace 500 as a component of the indoor unit thereof. The climate control system may include a system controller, which may be disposed in a thermostat of the climate control system and may be generally configured to affect control over the indoor and outdoor units of the climate control system. For example, the system controller may request a target firing rate of the burner assembly 540 of the furnace 500 in response to an ambient temperature of a comfort zone conditioned by the climate control system falling below a user-defined set point temperature. In some examples, control circuitry 590 may comprise a controller of the furnace 500 that is separate and distinct from, but in selective communication with, one or more controllers or control boards of the climate control system (e.g., the system controller of the climate control system, etc.). However, in other examples, the control circuitry 590 may comprise a plurality of controllers or control boards of the climate control system that are coupled to one another. For example, in some examples, the control circuitry 590 may comprise both a controller or control board of furnace 500 and the system controller of the climate control system disposed in the thermostat thereof. Thus, in some examples, one or more controllers or control boards of control circuitry 590 may affect control over components of the climate control system other than the furnace 500, e.g., the outdoor unit of the climate control system, and/or the like.

In some examples, the control circuitry 590 may be configured to receive information related to a speed and/or a torque of the circulation fan 580, whereby the control circuitry 590 may continuously determine the speed and the torque of the motor 583 of the circulation fan 580. Additionally, the control circuitry 590 may be configured to estimate an airflow produced by the circulation fan 580 by monitoring one or more parameters of the motor 583 of the circulation fan 580, such as a speed and a torque of the motor 583. The one or more parameters of the motor 583 may be measured parameters of motor 583 and/or parameters determined from measured parameters of motor 583. For example, the motor 583 may comprise one or more sensors configured to measure one or more parameters of motor 583, such as current, a counter or back electromotive force (EMF) of motor 583, a voltage supplied to the motor 583, and/or the like. The measured parameters of the motor 583 measured by the one or more sensors thereof may be communicated to the control circuitry 590. The control circuitry 590 may be configured to determine one or more parameters of the motor 583, such as the speed and torque of the motor 583, based on the parameters of the motor 583 measured by the one or more sensors of the motor 583 and communicated to the control circuitry 590. Additionally, in some examples, the control circuitry 590 may be configured to determine one or more parameters of the motor 583 of the circulation fan 580, such as a speed and a torque of the motor 583, required to achieve a desired or targeted airflow rate of the circulation fan 580. For example, the control circuitry 590 may monitor and adjust one or more measured parameters of the motor 583 (e.g., a current and/or voltage supplied to the motor 583) to ensure a speed and torque of the motor 583 required to achieve the targeted airflow rate is maintained. In some examples, the motor 583 may be the same or substantially similar to the motor of inducer fan 570.

The furnace 500 may be operated to provide heat to one or more areas and/or comfort zones of an indoor space by transferring heat from hot combustion gases flowing along the combustion flow path 572 generated by the furnace 500 to a conditioned airflow 584 that may be delivered to the comfort zone of the indoor space. For example, the control circuitry 590 of the furnace 500 may "turn on" or activate the burner assembly 540 of furnace 500 by opening the modulating gas valve 502 and operating the igniter 544 and the draft inducer fan 570 of the furnace 500 to thereby combust fuel and air in the burner assembly 540 and/or the heat exchanger 550 and induce a flow of combustion gases along the combustion flow path 572. Additionally, as combustion gases are circulated along combustion flow path 572, the control circuitry 590 may operate the circulation fan 580 to receive an inlet airflow 582 and circulate (e.g., blow or pull) air over the exterior surface 556 of heat exchanger 550. The circulation fan 580 may also be operated by control circuitry 590 to circulate the conditioned airflow 584 from the furnace 500 to the comfort zone of the indoor space. In some examples, the control circuitry 590 may also cease activation or deactivate furnace 500 by "shutting off" or deactivating the burner assembly 540 by closing the modulating gas valve 502 and ramping down the speed of draft inducer fan 570 to thereby cease the flow of combustion gases along combustion flow path 572 after sufficiently exhausting the combustion by-products. The control circuitry 590 may also cease the operation of circulation fan 580 following the deactivation of burner assembly 540, which may include a fan off delay to maximize removal of heat from the heat exchanger to the conditioned airflow.

FIG. 6 illustrates the control circuitry 600, which may be an apparatus, according to some examples of the present disclosure. In some examples, the control circuitry 600 includes some or all of a system controller, an indoor controller, an outdoor controller, or any other similar apparatus as described by the present disclosure. In some examples, the control circuitry 600 may include one or more of each of a number of components such as, for example, a processor 602 connected to a memory 604. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 602 may be a number of processors, a multi-core processor or some other type of processor, depending on the particular example.

The processor 602 may be configured to execute computer programs such as computer-readable program code 606, which may be stored onboard the processor or otherwise stored in the memory 604. In some examples, the processor may be embodied as, or otherwise include, one or more ASICs, FPGAs or the like. Thus, although the processor may be capable of executing a computer program to perform one or more functions, the processor of various examples may be capable of performing one or more functions without the aid of a computer program.

The memory 604 is generally any piece of computer hardware capable of storing information such as, for example, data, computer-readable program code 606 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 602, causes the control circuitry 600 to perform various operations as described herein, some of which may in turn cause the climate control system to perform various operations.

In addition to the memory 604, the processor 602 may also be connected to one or more peripherals such as a network adapter 608, e.g., for interfacing with a communication bus as described above, one or more input/output (I/O) devices (e.g., input device(s) 610, output device(s) 612) or the like. The network adapter is a hardware component configured to connect the control circuitry 600 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

As explained above and reiterated below, the present disclosure includes, without limitation, the following example implementations.

Clause 1. A furnace comprising: a heat exchanger; an inducer fan configured to move air from an air inlet through a combustion flow path; a burner assembly configured to combust a fuel and provide heat to the heat exchanger within the furnace; a circulation blower configured to circulate a conditioned air flow through the furnace and absorb heat from the heat exchanger; and control circuitry operably coupled to the inducer fan, the burner assembly, and the circulation blower, the control circuitry configured to: initiate combustion of the fuel in the burner assembly at an intermediate firing rate, the intermediate firing rate being greater than a minimum firing rate and less than a maximum firing rate; operate the furnace in a warm-up stage for a first period of time following initiating the combustion of the fuel, the warm-up stage including operating the burner assembly at the intermediate firing rate, operating the inducer fan, and maintaining the circulation blower in an off state; operate the furnace in a boost stage for a second period of time following the first period of time, the boost stage including operating the burner assembly at the intermediate firing rate, operating the inducer fan, and operating the circulation blower to flow circulation air through the furnace; and operate the furnace in a low-capacity setting following the second period of time, the low-capacity setting including operating the burner assembly at a low-capacity firing rate, operating the inducer fan, and continuing operation of the circulation blower, the low-capacity firing rate being a lower firing rate than the intermediate firing rate Clause 2. The furnace in any of the clauses, wherein the low-capacity firing rate is based on a requested heating demand from a conditioned space, and wherein the continuing operation of the circulation blower in the low-capacity setting includes adjusting the operation of the circulation blower based on the requested heating demand.

Clause 3. The furnace in any of the clauses, wherein the low-capacity firing rate is less than a required firing rate for ignition.

Clause 4. The furnace in any of the clauses, wherein the intermediate firing rate is a pre-selected firing rate for the furnace.

Clause 5. The furnace in any of the clauses, wherein the intermediate firing rate is between 55% and 75%.

Clause 6. The furnace in any of the clauses, wherein the intermediate firing rate is about 65%.

Clause 7. The furnace in any of the clauses, wherein the second period of time is a set period of time, the set period of time being greater than 5 seconds.

Clause 8. The furnace in any of the clauses, wherein the set period of time is based on a furnace type associated with the furnace, the furnace type being one of either a furnace make or model.

Clause 9. The furnace in any of the clauses, wherein the set period of time may be adjusted by an operator prior to initiating the combustion of the fuel.

Clause 10. The furnace in any of the clauses, wherein the second period of time is a variable period of time, the variable period of time ending based on a furnace condition.

Clause 11. The furnace in any of the clauses, wherein the furnace condition is an indication condensate has formed in a secondary heat exchanger.

Clause 12. The furnace in any of the clauses, wherein the furnace is a condensing furnace, and wherein the secondary heat exchanger is a condensing heat exchanger.

Clause 13. The furnace in any of the clauses, wherein operating the circulation fan in the boost stage further includes operating the circulation fan in a circulation boost operation.

Clause 14. A method of controlling a furnace to improve efficiency, the furnace including a heat exchanger, an inducer fan, a burner assembly, and a circulation blower, the method comprising: initiating combustion of a fuel in the burner assembly at an intermediate firing rate, the intermediate firing rate being greater than a minimum firing rate and less than a maximum firing rate; operating the furnace in a warm-up stage for a first period of time following initiating the combustion of the fuel, the warm-up stage including operating the burner assembly at the intermediate firing rate, operating the inducer fan, and maintaining the circulation blower in an off state; operating the furnace in a boost stage for a second period of time following the first period of time, the boost stage including operating the burner assembly at the intermediate firing rate, operating the inducer fan, and initiating operation of the circulation blower; and operating the furnace in a low-capacity setting following the second period of time, the low-capacity setting including operating the burner assembly at a low-capacity firing rate, operating the inducer fan, and operating the circulation blower to flow circulation air through the furnace, the low-capacity firing rate being a lower firing rate than the intermediate firing rate.

Clause 15. The method in any of the clauses, further comprising: receiving a call for a requested heating demand, wherein the low-capacity firing rate is based on the requested heating demand from a conditioned space, and wherein the continuing operation of the circulation blower in the low-capacity setting includes adjusting the operation of the circulation blower based on the requested heating demand.

Clause 16. The method in any of the clauses, wherein the low-capacity firing rate is less than a required firing rate for ignition.

Clause 17. The method in any of the clauses, wherein the intermediate firing rate is a pre-selected firing rate for the furnace.

Clause 18. The method in any of the clauses, wherein the intermediate firing rate is between 55% and 75%.

Clause 19. The method in any of the clauses, wherein the intermediate firing rate is about 65%.

Clause 20. The method in any of the clauses, wherein the second period of time is a set period of time, the set period of time being greater than 5 seconds.

Clause 21. The method in any of the clauses, wherein the set period of time is based on a furnace type associated with the furnace, the furnace type being one of either a furnace make or model.

Clause 22. The method in any of the clauses, further comprising setting the set period of time at a first time prior to initiating combustion of the fuel; and adjusting the set period of time based on an operator input at a second time prior to initiating combustion of the fuel, the second time being after the first time.

Clause 23. The method in any of the clauses, wherein the second period of time is a variable period of time, the variable period of time ending based on a furnace condition.

Clause 24. The method in any of the clauses, wherein the furnace condition is an indication condensate has formed in a heat exchanger.

Clause 25. The method in any of the clauses, wherein operating the circulation fan in the boost stage further includes operating the circulation fan in a circulation boost operation.

Many modifications, other embodiments, examples, or implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific embodiments, examples, or implementations disclosed and that modifications and other embodiments, examples, or implementations are intended to be included within the scope of the appended claims. Moreover, although the foregoing description and the associated figures describe embodiments, examples, or implementations in the context of certain example combinations of elements and/or functions, it should be appreciated that different combinations of elements and/or functions may be provided by alternative embodiments, examples, or implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A furnace comprising:

a heat exchanger;

an inducer fan configured to move air from an air inlet through a combustion flow path;

a burner assembly configured to combust a fuel and provide heat to the heat exchanger within the furnace;

a circulation blower configured to circulate a conditioned air flow through the furnace and absorb heat from the heat exchanger; and control circuitry operably coupled to the inducer fan, the burner assembly, and the circulation blower, the control circuitry configured to:

initiate combustion of the fuel in the burner assembly at an intermediate firing rate, the intermediate firing rate being greater than a minimum firing rate and less than a maximum firing rate;

operate the furnace in a warm-up stage for a first period of time following initiating the combustion of the fuel, the warm-up stage including operating the burner assembly at the intermediate firing rate, operating the inducer fan, and maintaining the circulation blower in an off state;

operate the furnace in a boost stage for a second period of time following the first period of time, the boost stage including operating the burner assembly at the intermediate firing rate, operating the inducer fan, and operating the circulation blower to flow circulation air through the furnace; and operate the furnace in a low-capacity setting following the second period of time, the low-capacity setting including operating the burner assembly at a low-capacity firing rate, operating the inducer fan, and continuing operation of the circulation blower, the low-capacity firing rate being a lower firing rate than the intermediate firing rate.

2. The furnace of claim 1, wherein the low-capacity firing rate is based on a requested heating demand from a conditioned space, and wherein the continuing operation of the circulation blower in the low-capacity setting includes adjusting the operation of the circulation blower based on the requested heating demand.

3. The furnace of claim 1, wherein the low-capacity firing rate is less than a required firing rate for ignition.

4. The furnace of claim 1, wherein the intermediate firing rate is between 55% and 75%.

5. The furnace of claim 1, wherein the intermediate firing rate is 65%.

6. The furnace of claim 1, wherein the second period of time is a set period of time, the set period of time being greater than 5 seconds.

7. The furnace of claim 6, wherein the set period of time is based on a furnace type associated with the furnace, the furnace type being one of either a furnace make or model.

8. The furnace of claim 6, wherein the set period of time is adjusted by an operator prior to initiating the combustion of the fuel.

9. The furnace of claim 1, wherein the second period of time is a variable period of time, the variable period of time ending based on a furnace condition.

10. The furnace of claim 9, wherein the furnace condition is an indication condensate has formed in a secondary heat exchanger.

11. The furnace of claim 10, wherein the furnace is a condensing furnace, and wherein the secondary heat exchanger is a condensing heat exchanger.

12. A method of controlling a furnace to improve efficiency, the furnace including a heat exchanger, an inducer fan, a burner assembly, and a circulation blower, the method comprising:

initiating combustion of a fuel in the burner assembly at an intermediate firing rate, the intermediate firing rate being greater than a minimum firing rate and less than a maximum firing rate;

operating the furnace in a warm-up stage for a first period of time following initiating the combustion of the fuel, the warm-up stage including operating the burner assembly at the intermediate firing rate, operating the inducer fan, and maintaining the circulation blower in an off state;

operating the furnace in a boost stage for a second period of time following the first period of time, the boost stage including operating the burner assembly at the intermediate firing rate, operating the inducer fan, and initiating operation of the circulation blower; and operating the furnace in a low-capacity setting following the second period of time, the low-capacity setting including operating the burner assembly at a low-capacity firing rate, operating the inducer fan, and operating the circulation blower to flow circulation air through the furnace, the low-capacity firing rate being a lower firing rate than the intermediate firing rate.

13. The method of claim 12, further comprising:

receiving a call for a requested heating demand, wherein the low-capacity firing rate is based on the requested heating demand from a conditioned space, and wherein the continuing operation of the circulation blower in the low-capacity setting includes adjusting the operation of the circulation blower based on the requested heating demand.

14. The method of claim 12, wherein the low-capacity firing rate is less than a required firing rate for ignition.

15. The method of claim 12, wherein the intermediate firing rate is a pre-selected firing rate for the furnace.

16. The method of claim 12, wherein the second period of time is a set period of time, the set period of time being greater than 5 seconds.

17. The method of claim 16, wherein the set period of time is based on a furnace type associated with the furnace, the furnace type being one of either a furnace make or model.

18. The method of claim 17, further comprising:

setting the set period of time at a first time prior to initiating combustion of the fuel; and adjusting the set period of time based on an operator input at a second time prior to initiating combustion of the fuel, the second time being after the first time.

19. The method of claim 12, wherein the second period of time is a variable period of time, the variable period of time ending based on a furnace condition.

20. The method of claim 19, wherein the furnace condition is an indication condensate has formed in a heat exchanger.

* * * * *